US010068517B2

(12) United States Patent
Whangbo

(10) Patent No.: US 10,068,517 B2
(45) Date of Patent: Sep. 4, 2018

(54) DISPLAY APPARATUS

(71) Applicant: SAMSUNG DISPLAY CO., LTD., Yongin-si, Gyeonggi-Do (KR)

(72) Inventor: Sangwoo Whangbo, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 70 days.

(21) Appl. No.: 15/073,960

(22) Filed: Mar. 18, 2016

(65) Prior Publication Data

US 2016/0379542 A1 Dec. 29, 2016

(30) Foreign Application Priority Data

Jun. 25, 2015 (KR) ..... 10-2015-0090609

(51) Int. Cl.
*G09G 3/20* (2006.01)
*G09G 3/36* (2006.01)

(52) U.S. Cl.
CPC ..... *G09G 3/2018* (2013.01); *G09G 3/2022* (2013.01); *G09G 3/2081* (2013.01); *G09G 3/3607* (2013.01); *G09G 3/3648* (2013.01); *G09G 2310/08* (2013.01); *G09G 2320/0204* (2013.01); *G09G 2320/0247* (2013.01); *G09G 2320/0252* (2013.01); *G09G 2320/0257* (2013.01); *G09G 2320/0285* (2013.01); *G09G 2320/0673* (2013.01); *G09G 2340/16* (2013.01)

(58) Field of Classification Search
CPC .. G09G 3/2022; G09G 3/2081; G09G 3/3648; G09G 3/2018; G09G 3/3607; G09G 2320/0252; G09G 2320/0285; G09G 2340/16; G09G 2310/08; G09G 2320/0204; G09G 2320/0247; G09G 2320/0257; G09G 2320/0673
See application file for complete search history.

(56) References Cited

U.S. PATENT DOCUMENTS

2006/0125812 A1* 6/2006 Lee ..... G09G 3/3648 345/204
2010/0156951 A1* 6/2010 Park ..... G09G 3/3648 345/690
2012/0113102 A1* 5/2012 Sato ..... H04N 13/0438 345/419

(Continued)

FOREIGN PATENT DOCUMENTS

KR 1020080054190 6/2008
KR 1020130134567 12/2013
KR 1020140003146 1/2014

OTHER PUBLICATIONS

European Search Report dated Oct. 26, 2016 in corresponding European Patent Application No. 16171297.1.

*Primary Examiner* — Md Saiful A Siddiqui
(74) *Attorney, Agent, or Firm* — F. Chau & Associates, LLC

(57) ABSTRACT

A display apparatus includes a timing controller and a display panel, in which the timing controller generates first output image data based on first input image data corresponding to a first frame set, the display panel includes a plurality of pixels and displays a first output image based on the first output image data during the first frame set, and the first frame set includes a first frame and a second frame, where the duration of the second frame is different from the duration of the first frame.

38 Claims, 18 Drawing Sheets

(56) References Cited

U.S. PATENT DOCUMENTS

| | | | | |
|---|---|---|---|---|
| 2013/0321483 | A1* | 12/2013 | You | G09G 5/10 345/690 |
| 2013/0342590 | A1* | 12/2013 | Lee | G09G 5/10 345/691 |
| 2014/0049713 | A1 | 2/2014 | No et al. | |
| 2014/0247289 | A1 | 9/2014 | Park et al. | |
| 2017/0169770 | A1* | 6/2017 | Tang | G09G 3/3607 |

* cited by examiner

DISPLAY APPARATUS

CROSS-REFERENCE TO RELATED APPLICATION

This application claims priority under 35 U.S.C. § 119 to Korean Patent Application No. 10-2015-0090609, filed on Jun. 25, 2015 in the Korean Intellectual Property Office (KIPO), the contents of which are herein incorporated by reference in their entirety.

TECHNICAL FIELD

Exemplary embodiments relate generally to display systems, and more particularly to display apparatuses and methods of operating the display apparatuses.

DISCUSSION OF RELATED ART

A liquid crystal display (LCD) apparatus may include a first substrate including a pixel electrode, a second substrate including a common electrode, and a liquid crystal layer disposed between the first and second substrates. Voltages may be applied to the pixel electrode and the common electrode to generate an electric field. Transmittance of light passing through the liquid crystal layer may be controlled according to the electric field, and thus, a desired image may be displayed.

To enhance visibility of the LCD apparatus, a temporal gamma mixing (TGM) scheme may be employed that establishes one frame set based on at least two frames and displays an original image during one frame set by combining at least one frame image having a grayscale higher than that of the original image during at least one frame and at least one frame image having a grayscale lower than that of the original image during at least one frame. A moving artifact and/or flicker may appear on the LCD apparatus operating based on the TGM scheme.

SUMMARY

An exemplary embodiment of the present disclosure provides a display apparatus and a method of operating the display apparatus. In an exemplary embodiment, a display apparatus includes a timing controller and a display panel, in which the timing controller generates first output image data based on first input image data corresponding to a first frame set, the display panel includes a plurality of pixels and displays a first output image based on the first output image data during the first frame set, and the first frame set includes a first frame and a second frame, where the duration of the second frame is different from the duration of the first frame.

According to an exemplary embodiment, a display apparatus includes a timing controller and a display panel. The timing controller generates first output image data based on first input image data corresponding to a first frame set. The display panel includes a plurality of pixels and displays a first output image based on the first output image data during the first frame set. The first frame set includes a first frame and a second frame. A duration of the second frame is different from a duration of the first frame. The first output image includes a first image and a second image. The first image has first grayscales and is displayed on the display panel during the first frame. The second image has second grayscales different from the first grayscales and is displayed on the display panel during the second frame. The first and second frames may be two consecutive frames.

In an exemplary embodiment, a rising response for a liquid crystal in the display panel may be implemented during the first frame. A falling response for the liquid crystal may be implemented during the second frame.

In an exemplary embodiment, the duration of the first frame may be longer than the duration of the second frame. In an exemplary embodiment, the duration of the first frame may be shorter than the duration of the second frame. In an exemplary embodiment, the timing controller may perform a dynamic capacitance compensation (DCC) on the first input image data to compensate the rising response for the liquid crystal.

In an exemplary embodiment, a first data voltage applied to a first pixel among the plurality of pixels during the first frame may be generated based on a first gamma curve. A second data voltage applied to the first pixel during the second frame may be generated based on a second gamma curve different from the first gamma curve.

A luminance of a first partial image displayed on the first pixel based on the first data voltage may be higher than a luminance of a second partial image displayed on the first pixel based on the second data voltage. In an exemplary embodiment, a polarity of the first data voltage with respect to a common voltage may be different from a polarity of the second data voltage with respect to the common voltage.

In an exemplary embodiment, the timing controller may further generate second output image data based on second input image data corresponding to a second frame set subsequent to the first frame set. The display panel may further display a second output image based on the second output image data during the second frame set. The second frame set may include a third frame and a fourth frame. A duration of the fourth frame may be different from a duration of the third frame. The second output image includes a third image and a fourth image. The third image may have third grayscales and may be displayed on the display panel during the third frame. The fourth image may have fourth grayscales different from the third grayscales and may be displayed on the display panel during the fourth frame.

In an exemplary embodiment, a first data voltage applied to a first pixel among the plurality of pixels during the first frame and a second data voltage applied to the first pixel during the third frame may be generated based on a first gamma curve. A third data voltage applied to the first pixel during the second frame and a fourth data voltage applied to the first pixel during the fourth frame may be generated based on a second gamma curve different from the first gamma curve.

In an exemplary embodiment, a first data voltage applied to a first pixel among the plurality of pixels during the first frame and a second data voltage applied to the first pixel during the fourth frame may be generated based on a first gamma curve. A third data voltage applied to the first pixel during the second frame and a fourth data voltage applied to the first pixel during the third frame may be generated based on a second gamma curve different from the first gamma curve.

In an exemplary embodiment, each of the plurality of pixels may include a first sub-pixel and a second sub-pixel. A first partial image displayed on the first sub-pixel and a second partial image displayed on the second sub-pixel may be generated based on a same gamma curve or different gamma curves.

According to exemplary embodiments, a display apparatus includes a timing controller and a display panel. The timing controller generates first output image data based on first input image data corresponding to a first frame set. The display panel includes a plurality of pixels and displays a first output image based on the first output image data during the first frame set. The first frame set includes a first frame, a second frame, a third frame and a fourth frame. A duration of the second frame is different from a duration of the first frame, a duration of the third frame is different from the duration of the second frame, and a duration of the fourth frame is different from the duration of the third frame. The first output image includes a first image, a second image, a third image and a fourth image. The first image has first grayscales and is displayed on the display panel during the first frame. The second image has second grayscales different from the first grayscales and is displayed on the display panel during the second frame. The third image has third grayscales different from the second grayscales and is displayed on the display panel during the third frame. The fourth image has fourth grayscales different from the third grayscales and is displayed on the display panel during the fourth frame. The first, second, third and fourth frames may be four consecutive frames.

In an exemplary embodiment, a rising response for a liquid crystal in the display panel may be performed during the first and third frames. A falling response for the liquid crystal may be performed during the second and fourth frames.

In an exemplary embodiment, the duration of the first frame may be longer than the duration of the second frame. The duration of the third frame may be longer than the duration of the fourth frame. In an exemplary embodiment, the duration of the first frame may be shorter than the duration of the second frame. The duration of the third frame may be shorter than the duration of the fourth frame.

In an exemplary embodiment, the timing controller may perform a dynamic capacitance compensation (DCC) on the first input image data to compensate the rising response for the liquid crystal. In an exemplary embodiment, a first data voltage applied to a first pixel among the plurality of pixels during the first frame and a second data voltage applied to the first pixel during the third frame may be generated based on a first gamma curve. A third data voltage applied to the first pixel during the second frame and a fourth data voltage applied to the first pixel during the fourth frame may be generated based on a second gamma curve different from the first gamma curve.

In an exemplary embodiment, a first data voltage applied to a first pixel among the plurality of pixels during the first frame may be generated based on a first gamma curve. A second data voltage applied to the first pixel during the second frame, a third data voltage applied to the first pixel during the third frame and a fourth data voltage applied to the first pixel during the fourth frame may be generated based on a second gamma curve different from the first gamma curve.

In an exemplary embodiment, a fifth data voltage applied to a second pixel adjacent to the first pixel during the first frame may be generated based on the first gamma curve. A sixth data voltage applied to the second pixel during the second frame, a seventh data voltage applied to the second pixel during the third frame and an eighth data voltage applied to the second pixel during the fourth frame may be generated based on the second gamma curve.

In an exemplary embodiment, a fifth data voltage applied to a second pixel adjacent to the first pixel during the first frame, a sixth data voltage applied to the second pixel during the second frame, a seventh data voltage applied to the second pixel during the fourth frame may be generated based on the second gamma curve. An eighth data voltage applied to the second pixel during the third frame may be generated based on the first gamma curve.

According to an exemplary embodiment method of operating a display apparatus, first output image data is generated based on first input image data corresponding to a first frame set including a first frame and a second frame. A first image is displayed on a display panel based on the first output image data during the first frame. The first image has first grayscales. A second image is displayed on the display panel based on the first output image data during the second frame. The second image has second grayscales different from the first grayscales. A duration of the second frame is different from a duration of the first frame. A first output image displayed on the display panel during the first frame set includes the first image and the second image. The first and second frames may be two consecutive frames.

In an exemplary embodiment, a rising response for a liquid crystal in the display panel may be implemented during the first frame. A falling response for the liquid crystal may be implemented during the second frame.

In an exemplary embodiment, the duration of the first frame may be longer than the duration of the second frame. In an exemplary embodiment, the duration of the first frame may be shorter than the duration of the second frame.

An exemplary embodiment method of operating a display apparatus includes generating first output image data based on first input image data corresponding to a first frame set including a first frame, a second frame, and a third frame; displaying a first image on a display panel based on the first output image data during the first frame, the first image having first grayscales; displaying a second image on the display panel based on the first output image data during the second frame, the second image having second grayscales different from the first grayscales; displaying a third image on the display panel based on the first output image data during the a duration of a third frame of the plurality of frames, the third image having third grayscales different from at least one of the second and first grayscales, where the duration of the third frame is different from at least one of the durations of the second and first frames, and where the first output image displayed on the display panel during the first frame set includes the third image.

According to an exemplary embodiment method of operating a display apparatus, first output image data is generated based on first input image data corresponding to a first frame set including a first frame, a second frame, a third frame and a fourth frame. A first image is displayed on a display panel based on the first output image data during the first frame. The first image has first grayscales. A second image is displayed on the display panel based on the first output image data during the second frame. The second image has second grayscales different from the first grayscales. A third image is displayed on the display panel based on the first output image data during the third frame. The third image has third grayscales different from the second grayscales. A fourth image is displayed on the display panel based on the first output image data during the fourth frame. The fourth image has fourth grayscales different from the third grayscales. A duration of the second frame is different from a duration of the first frame, a duration of the third frame is different from the duration of the second frame, and a duration of the fourth frame is different from the duration of the third frame. A first output image displayed on the display panel during the first frame set includes the first image, the second image, the third image and the fourth image. The first, second, third and fourth frames may be four consecutive frames.

In an exemplary embodiment, a rising response for a liquid crystal in the display panel may be implemented during the first and third frames. A falling response for the liquid crystal may be implemented during the second and fourth frames.

In an exemplary embodiment, the duration of the first frame may be longer than the duration of the second frame. The duration of the third frame may be longer than the duration of the fourth frame.

In an exemplary embodiment, the duration of the first frame may be shorter than the duration of the second frame. The duration of the third frame may be shorter than the duration of the fourth frame.

The display apparatus according to an exemplary embodiment may operate based on a frame-set-by-frame-set basis, where each frame set includes at least two frames. In addition, the display apparatus according to an exemplary embodiment may operate based on an asymmetric frame dividing (AFD) scheme, where the at least two frames in one frame set may have different durations. Accordingly, the display apparatus may have relatively high transmittance, visibility and display quality.

An exemplary embodiment method includes generating a first data voltage for a pixel among a plurality of pixels in at least one frame of the first frame set based on a first gamma curve, and generating a second data voltage for the pixel in at least another frame of the frame set based on a second gamma curve. In an exemplary embodiment, the method includes generating a first data voltage for a first pixel or sub-pixel among a plurality of pixels in at least one frame of the first frame set based on a first gamma curve, and generating a second data voltage for a second pixel or sub-pixel in the at least one frame of the frame set based on a second gamma curve.

An exemplary embodiment electronic display system includes first pixel elements arranged in a matrix, and a timing controller coupled to second of the first pixel elements, where the timing controller drives third of the second pixel elements for a variable duration different from that of fourth of the first pixel elements.

In such a display system, the variable duration may be based on a difference in pixel data values between those corresponding to the third pixel elements and those corresponding to the fourth pixel elements. In such a display system, the variable duration my be based on a difference in at least one of physical, electrical, performance, or degradation parameters between the third pixel elements and the fourth pixel elements.

In such a display system, the third and fourth pixel elements may include substantially the same physical pixel elements, but at different times. In such a display system, the third and fourth pixel elements may include different physical pixel elements, but at substantially the same time.

Such a display system may further include a gamma generator coupled between an output from the timing controller and an input to the first pixel elements, where the gamma generator is configured to apply different gamma curves to at least some of the third and fourth pixel elements, respectively, based on the output from the timing controller.

BRIEF DESCRIPTION OF THE DRAWINGS

Illustrative, non-limiting exemplary embodiments will be more clearly understood from the following detailed description taken in conjunction with the accompanying drawings, in which like reference indicia may indicate like features.

DETAILED DESCRIPTION

Figure 1:
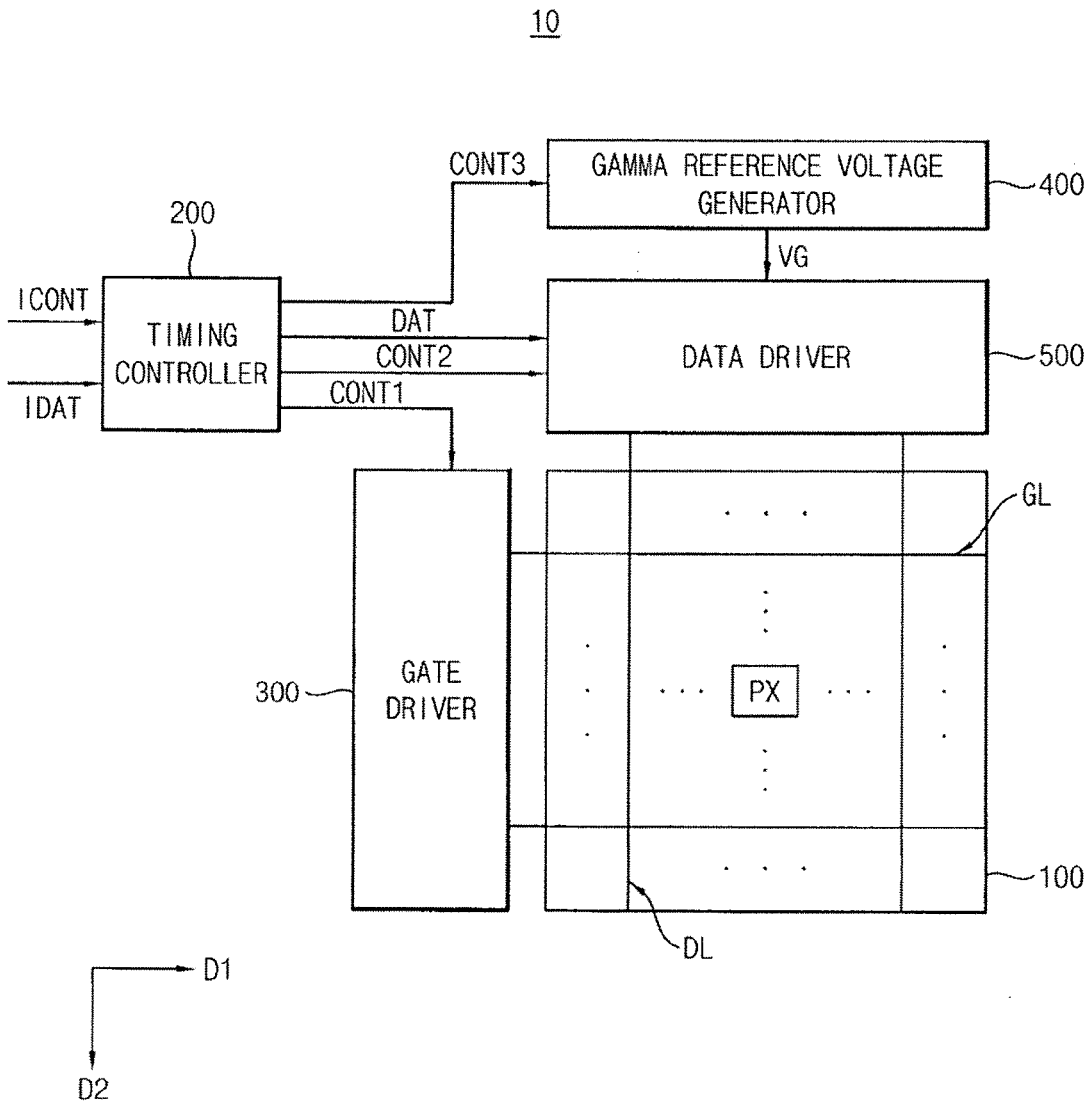
FIG. 1 is a schematic block diagram illustrating a display apparatus according to an exemplary embodiment of the inventive concept.

Various exemplary embodiments will be described more fully with reference to the accompanying drawings. The present inventive concept may, however, be embodied in many different forms and should not be construed as limited to the particular examples described herein. Like reference numerals may refer to like elements throughout this disclosure.

FIG. 1 is a block diagram illustrating a display apparatus according to exemplary embodiments. Referring to FIG. 1, a display apparatus 10 includes a display panel 100, a timing controller 200, a gate driver 300 connected from the timing controller to the display panel, a gamma reference voltage generator 400 connected from the timing controller, and a data driver 500 connected from the gamma reference voltage generator to the display panel.

The display panel 100 is connected to a plurality of gate lines GL from the gate driver and a plurality of data lines DL from the data driver. The display panel 100 displays an image represented by a plurality of grayscales based on output image data DAT. The gate lines GL may extend in a first direction D1, and the data lines DL may extend in a second direction D2 crossing (e.g., substantially perpendicular to) the first direction D1.

The display panel 100 may include a plurality of pixels PX that are arranged in a matrix layout. Each of the plurality of pixels PX may be electrically connected to a respective one of the gate lines GL and a respective one of the data lines DL.

Each of the plurality of pixels PX may include a switching element (e.g., an element Q in FIG. 5), a liquid crystal capacitor (not illustrated) and a storage capacitor (not illustrated). The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each of the plurality of pixels PX may have a rectangular shape. For example, each pixel may have a relatively long side in the first direction D1 and a relatively short side in the second direction D2. The relatively long side of each pixel may be substantially parallel to the gate lines GL. The relatively short side of each pixel may be substantially parallel to the data lines DL.

The timing controller 200 controls operations of the gate driver 300, the gamma reference voltage generator 400 and the data driver 500. The timing controller 200 receives input image data IDAT and an input control signal ICONT from an external device (e.g., a host). The input image data IDAT may include input pixel data for the plurality of pixels PX. The input pixel data may include red grayscale data R, green grayscale data G and blue grayscale data B. The input control signal ICONT may include a master clock signal, a data enable signal, a vertical synchronization signal, a horizontal synchronization signal, etc.

The timing controller 200 generates the output image data DAT, a first control signal CONT1, a second control signal CONT2 and a third control signal CONT3 based on the input image data IDAT and the input control signal ICONT.

The timing controller 200 may generate the output image data DAT based on the input image data IDAT. The output image data DAT may be provided to the data driver 500. Although some output image data DAT may be image data that is substantially the same as the input image data IDAT, the output image data DAT may include compensated image data that is generated by compensating the input image data IDAT. For example, the timing controller 200 may selectively perform an image quality compensation, a spot compensation, an adaptive color correction (ACC), and/or a dynamic capacitance compensation (DCC) on the input image data IDAT to generate the output image data DAT.

The timing controller 200 may generate the first control signal CONT1 based on the input control signal ICONT. The first control signal CONT1 may be provided to the gate driver 300, and a driving timing of the gate driver 300 may be controlled based on the first control signal CONT1. The first control signal CONT1 may include a vertical start signal, a gate clock signal, and the like. The timing controller 200 may generate the second control signal CONT2 based on the input control signal ICONT. The second control signal CONT2 may be provided to the data driver 500, and a driving timing of the data driver 500 may be controlled based on the second control signal CONT2. The second control signal CONT2 may include a horizontal start signal, a data clock signal, a data load signal, a polarity control signal, and the like. The timing controller 200 may generate the third control signal CONT3 based on the input control signal ICONT. The third control signal CONT3 may be provided to the gamma reference voltage generator 400, and a driving timing of the gamma reference voltage generator 400 may be controlled based on the third control signal CONT3.

The gate driver 300 receives the first control signal CONT1 from the timing controller 200. The gate driver 300 generates a plurality of gate signals for driving the gate lines GL based on the first control signal CONT1. The gate driver 300 may sequentially apply the plurality of gate signals to the gate lines GL.

The gamma reference voltage generator 400 receives the third control signal CONT3 from the timing controller 200. The gamma reference voltage generator 400 generates a gamma reference voltage VG based on the third control signal CONT3. The gamma reference voltage generator 400 provides the gamma reference voltage VG to the data driver 500. The gamma reference voltage VG may have values corresponding to grayscales of a plurality of output pixel data included in the output image data DAT.

The gamma reference voltage generator 400 may include a resistor string circuit (not illustrated) and generate an analog gamma reference voltage VG based on a power supply voltage, a ground voltage and the grayscales of the output pixel data. Alternatively, the gamma reference voltage generator 400 may generate a digital gamma reference voltage VG. The gamma reference voltage generator 400 may be located inside of the data driver 500.

The data driver 500 receives the second control signal CONT2 and the output image data DAT from the timing controller 200. The data driver 500 generates a plurality of analog data voltages based on the second control signal CONT2 and the digital output image data DAT. The data driver 500 may apply the plurality of data voltages to the data lines DL.

The data driver 500 may include a shift register (not illustrated), a latch (not illustrated), a signal processor (not illustrated) and a buffer (not illustrated). The shift register may output a latch pulse to the latch. The latch may temporarily store the output image data, and may output the output image data to the signal processor. The signal processor may generate the analog data voltages based on the digital output image data and may output the analog data voltages to the buffer. The buffer may output the analog data voltages to the data lines DL.

At least one of the gate driver 300, the gamma reference voltage generator 400 and/or the data driver 500 may be disposed, e.g., directly mounted, on the display panel 100, or may be connected to the display panel 100 in a tape carrier package (TCP) arrangement. Alternatively, at least one of the gate driver 300, the gamma reference voltage generator 400 and/or the data driver 500 may be integrated on the display panel 100.

The display apparatus 10 according to an exemplary embodiment may operate based on a temporal gamma mixing (TGM) scheme. In the TGM scheme, one frame set may include at least two frames, and one output image may be displayed on the display panel 100 during the one frame set. The one output image may include at least two frame images, each of which is displayed on the display panel 100 during a respective one of the at least two frames. In other words, the one output image may be a combination of the at least two frame images.

At least two gamma curves may be used for driving the display apparatus 10 based on the TGM scheme. For example, the gamma reference voltage VG may be generated based on the at least two gamma curves, and the at least two frame images may be displayed on the display panel 100 based on the gamma reference voltage VG having information associated with the at least two gamma curves. To operate the display apparatus 10 according to an exemplary embodiment, the at least two frames may have different durations.

Hereinafter, the display apparatus and the method of operating the display apparatus according to the inventive concept will be explained in detail with reference to exemplary configurations of the at least two frames in the one frame set and at least one pixel included in the display panel.

Figure 2:
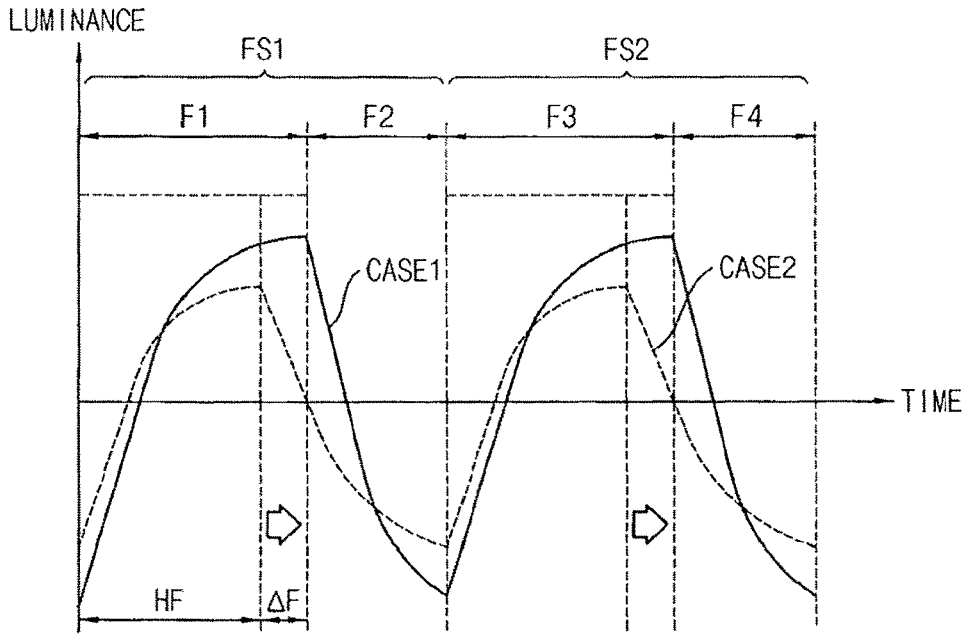
FIGS. 2 and 3 are graphical diagrams for illustrating a method of a display apparatus according to an exemplary embodiment.
Figure 3:
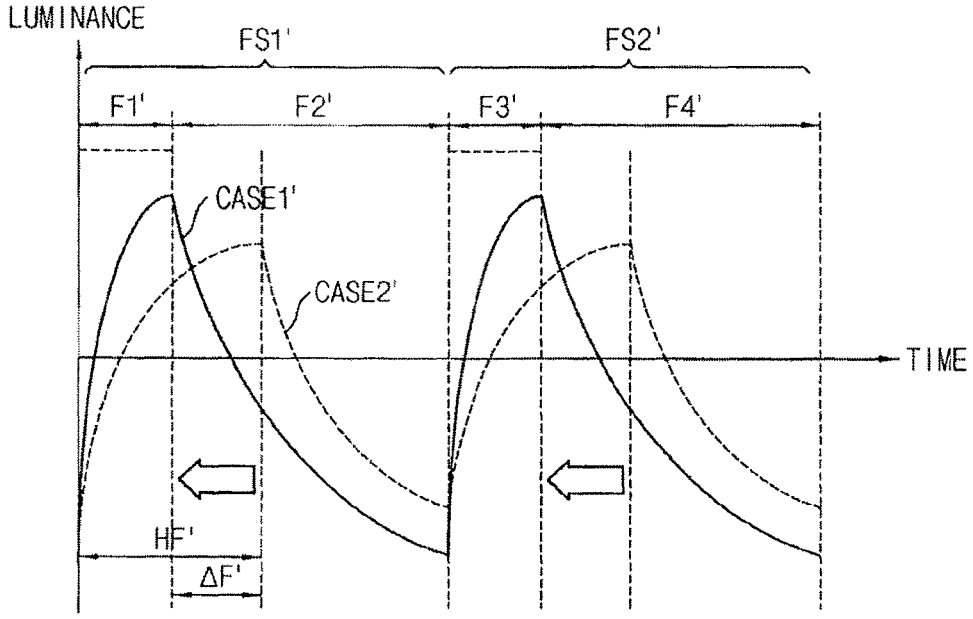

FIGS. 2 and 3 are diagrams for illustrating a method of a display apparatus according to an exemplary embodiment. FIGS. 2 and 3 illustrate a change of luminance by lapse of time or by lapse of frame.

In the method of the display apparatus according to an exemplary embodiment, one frame set (e.g., FS1 in FIG. 2) may include two frames (e.g., F1 and F2 in FIG. 2). A duration of one frame (e.g., F1 in FIG. 2) may be different from a duration of the other frame (e.g., F2 in FIG. 2). In other words, the one frame set may be asymmetrically divided into the two frames, and the display apparatus according to an exemplary embodiment may operate based on an asymmetric frame dividing (AFD) scheme and on the TGM scheme.

Referring to FIGS. 1 and 2, a first frame set FS1 includes a first frame F1 and a second frame F2. A duration of the second frame F2 is different from a duration of the first frame F1. For example, the first and second frames F1 and F2 may be two consecutive frames. A second frame set FS2 subsequent to the first frame set FS1 includes a third frame F3 and a fourth frame F4. A duration of the third frame F3 is different from a duration of the fourth frame F4. For example, the first and second frame sets FS1 and FS2 may be two consecutive frame sets, and the third and fourth frames F3 and F4 may be two consecutive frames.

The input image data IDAT may include data corresponding to a respective one of a plurality of frame sets. For example, the input image data IDAT may include first input image data corresponding to the first frame set FS1 and second input image data corresponding to the second frame set FS2. Similarly, the output image data DAT may include data corresponding to the respective one of the plurality of frame sets. For example, the output image data DAT may include first output image data corresponding to the first frame set FS1 and second output image data corresponding to the second frame set FS2.

The timing controller 200 generates the first output image data based on the first input image data. The data driver 500 may generate a plurality of first data voltages and a plurality of second data voltages based on the first output image data and the gamma reference voltage VG having information associated with at least two gamma curves.

The display panel 100 displays a first output image based on the first output image data during the first frame set FS1. For example, the display panel 100 displays a first image based on the first output image data (e.g., based on the first data voltages) during the first frame F1 and displays a second image based on the first output image data (e.g., based on the second data voltages) during the second frame F2. The first image has first grayscales, and the second image has second grayscales different from the first grayscales. The first output image includes the first image and the second image. In other words, the first output image may be displayed on the display panel 100 by combining the first and second images.

As illustrated in FIG. 2, the duration of the first frame F1 for CASE1 may be longer than the duration of the second frame F2 for CASE1, as compared to the substantially equal durations of the first and second frames for CASE2. For example, the duration of the first frame F1 may be longer than a half duration HF of the first frame set FS1 by ΔF. The duration of the second frame F2 may be shorter than the half duration HF of the first frame set FS1 by ΔF.

A rising response for a liquid crystal (LC) in the display panel 100 may be implemented during the first frame F1, and a falling response for the LC may be implemented during the second frame F2. In other words, a luminance of the display panel 100 may increase during the first frame F1 and may decrease during the second frame F2.

In some exemplary embodiments, when a half of a sum of the durations of the first and second frames F1 and F2 (e.g., the half duration HF of the first frame set FS1) is equal to or greater than a reference falling time for the LC, it may be determined that the duration of the first frame F1 is longer than the duration of the second frame F2. The reference falling time may be associated with a characteristic of the LC response and may indicate a minimum duration for performing the falling response. For example, if a duration of the first frame set FS1 is about 8.3 ms, and if the reference falling time is about 3.2 ms, the half duration HF of the first frame set FS1 may be greater than the reference falling time. In this case, the duration of the second frame F2 may be set (e.g., may decrease) to about 3.2 ms, which is substantially the same as the reference falling time. The duration of the first frame F1 may be set (e.g., may increase) to about 5.1 ms, which is obtained by subtracting the duration of the second frame F2 from the duration of the first frame set FS1. In comparison with a symmetric frame dividing scheme (e.g., CASE2 in FIG. 2), a rising time for the rising response may increase without a loss of the reference falling time in the AFD scheme (e.g., CASE1 in FIG. 2). Accordingly, the display panel 100 operating based on the AFD scheme may have an excellent LC response characteristic, a high transmittance and a desirable visibility.

An operation of the display apparatus 10 during the second frame set FS2 may be substantially the same as the operation of the display apparatus 10 during the first frame set FS1. The timing controller 200 may generate the second output image data based on the second input image data. The data driver 500 may generate a plurality of third data voltages and a plurality of fourth data voltages based on the second output image data and the gamma reference voltage VG having information associated with at least two gamma curves. The display panel 100 may display a second output image based on the second output image data during the second frame set FS2. For example, the display panel 100 may display a third image based on the second output image data (e.g., based on the third data voltages) during the third frame F3 and may display a fourth image based on the second output image data (e.g., based on the fourth data voltages) during the fourth frame F4. The third image may have third grayscales, and the fourth image may have fourth grayscales different from the third grayscales. The second output image includes the third image and the fourth image. In other words, the second output image may be displayed on the display panel 100 by combining the third and fourth images. The duration of the third frame F3 may be longer than the duration of the fourth frame F4. The durations of the third and fourth frames F3 and F4 may be substantially the same as the durations of the first and second frames F1 and F2, respectively, but are not limited thereto.

Although not illustrated in FIGS. 1 and 2, the durations of the first and second frames F1 and F2 may be determined by adjusting widths of gate pulses in the gate signals generated by the gate driver 300. For example, the gate pulses may have relatively wide widths during the first frame F1 and may have relatively narrow widths during the second frame F2.

Referring to FIGS. 1 and 3, a first frame set FS1' includes a first frame F1' and a second frame F2' that have different durations for CASE1', as compared to the substantially equal durations of the first and second frames for CASE2'. For example, the first and second frames F1' and F2' may be two consecutive frames. A second frame set FS2' subsequent to the first frame set FS1' includes a third frame F3' and a fourth frame F4' that have different durations. For example, the first and second frame sets FS1' and FS2' may be two consecutive frame sets, and the third and fourth frames F3' and F4' may be two consecutive frames.

The example of FIG. 3 may be similar to the example of FIG. 2 except that a frame configuration in FIG. 3 is different from a frame configuration in FIG. 2. The timing controller 200 of FIG. 1 generates first output image data based on first input image data corresponding to the first frame set FS1'. The display panel 100 displays a first output image based on the first output image data during the first frame set FS1'. For example, the display panel 100 displays a first image based on the first output image data during the first frame F1' and displays a second image based on the first output image data during the second frame F2'. The first image has first grayscales, and the second image has second grayscales different from the first grayscales. The first output image is displayed on the display panel 100 by combining the first and second images. In addition, the timing controller 200 may generate second output image data based on second input image data corresponding to the second frame set FS2'. The display panel 100 may display a second output image based on the second output image data during the second frame set FS2'. For example, the display panel 100 may display a third image based on the second output image data during the third frame F3' and may display a fourth image based on the second output image data during the fourth frame F4'. The third image may have third grayscales, and the fourth image may have fourth grayscales different from the third grayscales. The second output image may be displayed on the display panel 100 by combining the third and fourth images.

As illustrated in FIG. 3, the duration of the first frame F1' may be shorter than the duration of the second frame F2'. For example, the duration of the first frame F1' may be shorter than a half duration HF' of the first frame set FS1' by ΔF'. The duration of the second frame F2' may be longer than the half duration HF' of the first frame set FS1' by ΔF'. The duration of the third frame F3' may be shorter than the duration of the fourth frame F4'. The durations of the third and fourth frames F3' and F4' may be substantially the same as the durations of the first and second frames F1' and F2', respectively, but are not limited thereto.

As illustrated in FIG. 3, the rising response for the LC in the display panel 100 may be implemented during the first frame F1', and the falling response for the LC may be implemented during the second frame F2'.

In an exemplary embodiment, when a half of a sum of the durations of the first and second frames F1' and F2' (e.g., the half duration HF' of the first frame set FS1') is less than the reference falling time for the LC, it may be determined that the duration of the first frame F1' is shorter than the duration of the second frame F2'. For example, if a duration of the first frame set FS1' is about 3.7 ms, and if the reference falling time is about 3.2 ms, the half duration HF' of the first frame set FS1' may be less than the reference falling time. In this case, the duration of the second frame F2' may be set (e.g., may increase) to about 2.7 ms, which is as close as possible to the reference falling time. The duration of the first frame F1' may be set (e.g., may decrease) to about 1.0 ms, which may be confirmed by subtracting the duration of the second frame F2' from the duration of the first frame set FS1'.

The timing controller 200 may perform the DCC on the first input image data to compensate the rising response for the LC. Similarly, the timing controller 200 may perform the DCC on the second input image data to compensate the rising response for the LC. In comparison with the symmetric frame dividing scheme (e.g., CASE2' in FIG. 3), the rising response may be effectively performed with the DCC in the AFD scheme (e.g., CASE1' in FIG. 3), even if a rising time for the rising response decreases, and thus a falling time for the falling response may be set as close as possible to the reference falling time in the AFD scheme (e.g., CASE1' in FIG. 3). Accordingly, the display panel 100 operating based on the AFD scheme may have an excellent LC response characteristic, a relatively high transmittance and a desirable visibility.

Examples based on the AFD scheme (e.g., as illustrated in FIGS. 2 and 3) and the TGM scheme will be explained in detail with reference to FIGS. 4, 5, 6A, 6B, 7, 8, 9, 10, 11, 12, 13A and 13B.

Figure 4:
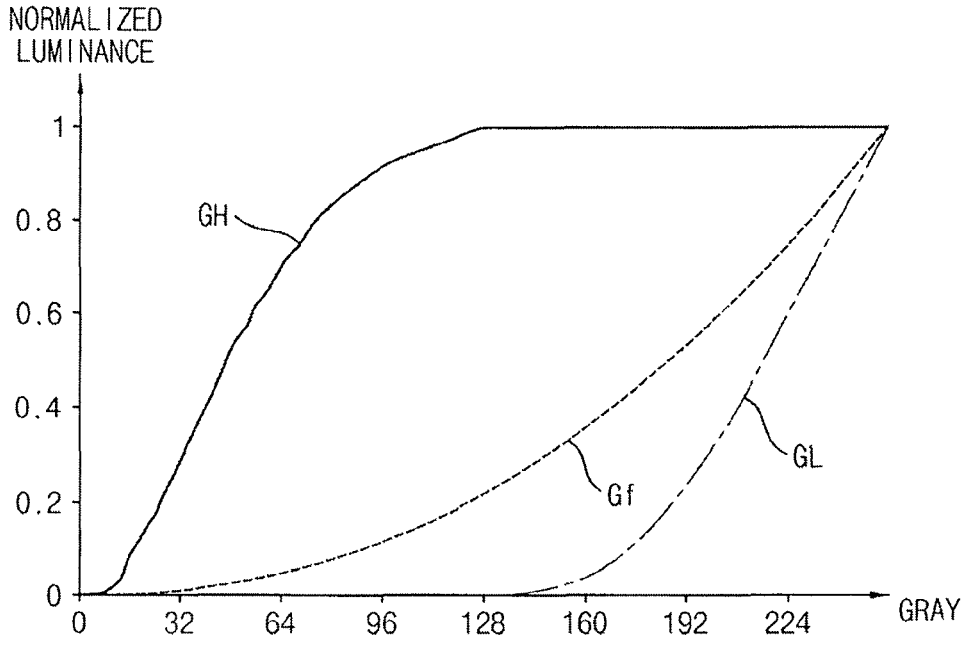
FIG. 4 is a graphical diagram illustrating an example of gamma curves that are used in the display apparatus according to an exemplary embodiment.

FIG. 4 is a graph illustrating an example of gamma curves that are used in the display apparatus according to an exemplary embodiment.

Referring to FIGS. 1 and 4, the gamma reference voltage VG may be generated based on a first gamma curve GH and a second gamma curve GL. A luminance of an image based on the first gamma curve GH may be equal to or higher than a luminance of an image based on the second gamma curve GL. The first and second gamma curves GH and GL may be controlled such that a combination gamma curve of the first and second gamma curves GH and GL conforms with a reference gamma curve Gf (e.g., a gamma curve with a gamma value of about 2.2), which is determined to substantially maximize the display quality of the display panel 100, for example.

The display apparatus 10 may include a storage (not illustrated) that stores gamma data associated with the first and second gamma curves GH and GL. The storage may be disposed inside or outside of the timing controller 200.

Figure 5:
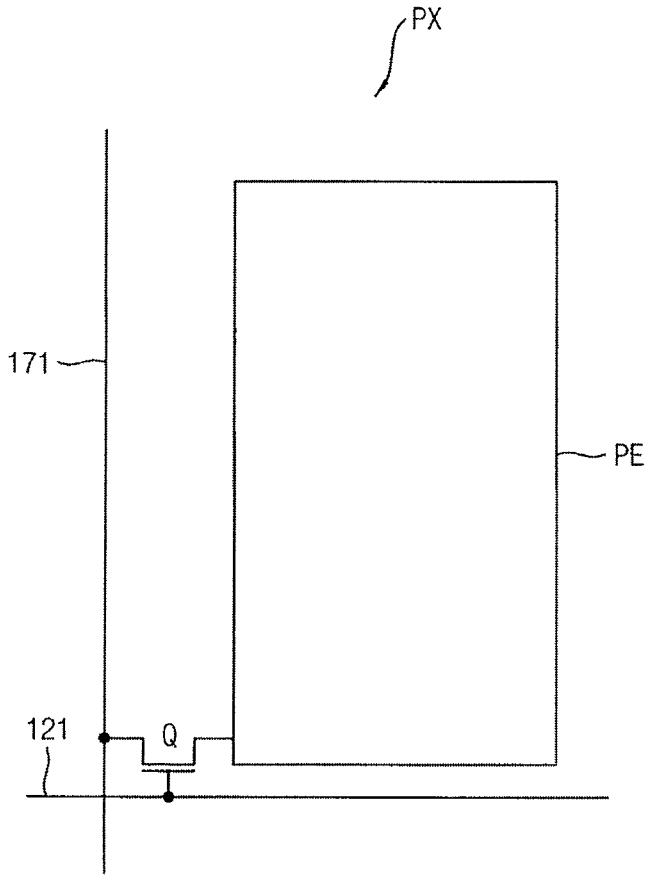
FIG. 5 is a schematic plan view diagram illustrating one pixel included in the display apparatus according to an exemplary embodiment.

FIG. 5 is a plan view illustrating one pixel included in the display apparatus according to an exemplary embodiment. Referring to FIG. 5, a pixel PX may include a switching element Q connected to a data line 171 and a gate line 121, and a pixel electrode PE connected to the switching element Q. For example, the switching element Q may be a thin film transistor. The switching element Q may be controlled based on a gate signal transmitted by the gate line 121 and may apply a data voltage transmitted by the data line 171 to the pixel electrode PE.

Figure 6A:
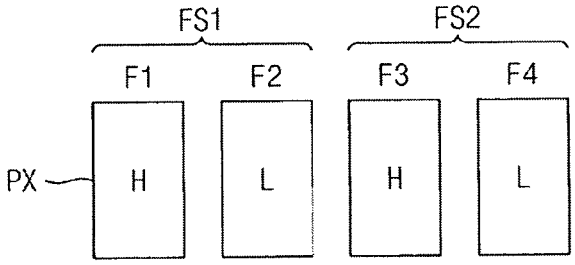
FIGS. 6A and 6B are conceptual diagrams illustrating examples of a temporal gamma mixing (TGM) scheme based on the pixel of FIG. 5.
Figure 6B:
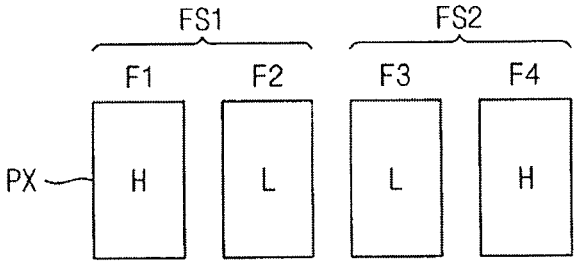

FIGS. 6A and 6B are diagrams illustrating examples of a temporal gamma mixing (TGM) scheme based on the pixel of FIG. 5. Referring to FIGS. 6A and 6B, the pixel PX may operate based on a frame-set-by-frame-set basis, where each frame set includes two frames (e.g., two consecutive frames). For example, a portion of the first output image may be displayed on the pixel PX during the first frame set FS1 (e.g., during the first and second frames F1 and F2), and a portion of the second output image may be displayed on the pixel PX during the second frame set FS2 (e.g., during the third and fourth frames F3 and F4). The duration of the second frame F2 may be different from the duration of the first frame F1, and the duration of the third frame F3 may be different from the duration of the fourth frame F4.

An image (e.g., referred to as a first partial image H) based on the first gamma curve GH in FIG. 4 may be displayed on the pixel PX during one of two frames in one frame set, and an image (e.g., referred to as a second partial image L) based on the second gamma curve GL in FIG. 4 may be displayed on the pixel PX during the other of two frames in one frame set. The images based on the different gamma curves may be displayed in the consecutive frames such that the combination gamma curve is substantially close to the reference gamma curve Gf in FIG. 4.

In an exemplary embodiment as illustrated in FIG. 6A, a first data voltage applied to the pixel PX during the first frame F1 may be generated based on the first gamma curve GH in FIG. 4, a second data voltage applied to the pixel PX during the second frame F2 may be generated based on the second gamma curve GL in FIG. 4, a third data voltage applied to the pixel PX during the third frame F3 may be generated based on the first gamma curve GH in FIG. 4, and a fourth data voltage applied to the pixel PX during the fourth frame F4 may be generated based on the second gamma curve GL in FIG. 4. In other words, the pixel PX may display the first partial image H during the first frame F1, may display the second partial image L during the second frame F2, may display the first partial image H during the third frame F3, and may display the second partial image L during the fourth frame F4.

In an exemplary embodiment, a luminance of the first partial image H displayed on the pixel PX based on the first data voltage may be equal to or higher than a luminance of the second partial image L displayed on the pixel PX based on the second data voltage. Although not illustrated in FIG. 6A, during two frame sets subsequent to the second frame set FS2, the partial images may be displayed on the pixel PX in a sequence of H-L-H-L, which is substantially the same as a display sequence during the first through fourth frames F1~F4 in FIG. 6A, or in a sequence of L-H-L-H, which is different from the display sequence during the first through fourth frames F1~F4 in FIG. 6A.

As will be described with reference to FIG. 21, the display panel may operate based on an inversion driving scheme in which a polarity of a data voltage applied to each pixel is reversed with respect to the common voltage per a set or predetermined period. In this case, a polarity of the first data voltage with respect to the common voltage may be different from a polarity of the second data voltage with respect to the common voltage. For example, the first data voltage may have a positive polarity, and the second data voltage may have a negative polarity.

In an exemplary embodiment as illustrated in FIG. 6B, a first data voltage applied to the pixel PX during the first frame F1 may be generated based on the first gamma curve GH in FIG. 4, a second data voltage applied to the pixel PX during the second frame F2 may be generated based on the second gamma curve GL in FIG. 4, a third data voltage applied to the pixel PX during the third frame F3 may be generated based on the second gamma curve GL in FIG. 4, and a fourth data voltage applied to the pixel PX during the fourth frame F4 may be generated based on the first gamma curve GH in FIG. 4. In other words, the pixel PX may display the first partial image H during the first frame F1, may display the second partial image L during the second frame F2, may display the second partial image L during the third frame F3, and may display the first partial image H during the fourth frame F4.

As illustrated in FIG. 6B, when a display sequence of the first partial image H and the second partial image L in the consecutive frame set is reversed, the second partial image L having the lower luminance may be displayed in the consecutive frame such that the slow response speed of the LC in the display panel 100 in FIG. 1 may be compensated. Thus, the display panel 100 may have a desirable visibility.

Although not illustrated in FIG. 6B, during two frame sets subsequent to the second frame set FS2, the partial images may be displayed on the pixel in a sequence of H-L-L-H, which is substantially the same as a display sequence during the first through fourth frames F1-F4 in FIG. 6B, or in a sequence of L-H-H-L, which is different from the display sequence during the first through fourth frames F1~F4 in FIG. 6B.

According to an exemplary embodiment using the TGM and AFD schemes based on the pixel of FIG. 5, the images based on the different gamma curves may be displayed on the pixel PX such that the combination gamma curve (e.g., the combination of GH and GL in FIG. 4) is substantially close to the reference gamma curve Gf in FIG. 4, thereby providing excellent transmittance and visibility.

Figure 7:
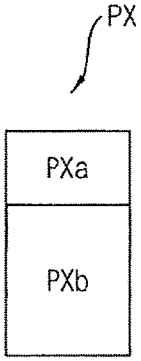
FIG. 7 is a schematic plan view diagram illustrating a pixel included in the display apparatus according to an exemplary embodiment.

FIG. 7 is a plan view illustrating a pixel included in the display apparatus according to an exemplary embodiment. Referring to FIG. 7, a pixel PX may include a first sub-pixel PXa and a second sub-pixel PXb. The first sub-pixel PXa and the second sub-pixel PXb may display an image for output image data based on different gamma curves or based on a same gamma curve.

In an exemplary embodiment, an area of the first sub-pixel PXa may be different from an area of the second sub-pixel PXb. For example, the area of the second sub-pixel PXb may be greater than the area of the first sub-pixel PXa. Alternatively, although not illustrated in FIG. 7, the area of the second sub-pixel PXb may be smaller than the area of the first sub-pixel PXa, or the area of the second sub-pixel PXb may be substantially the same as the area of the first sub-pixel PXa.

Figure 8:
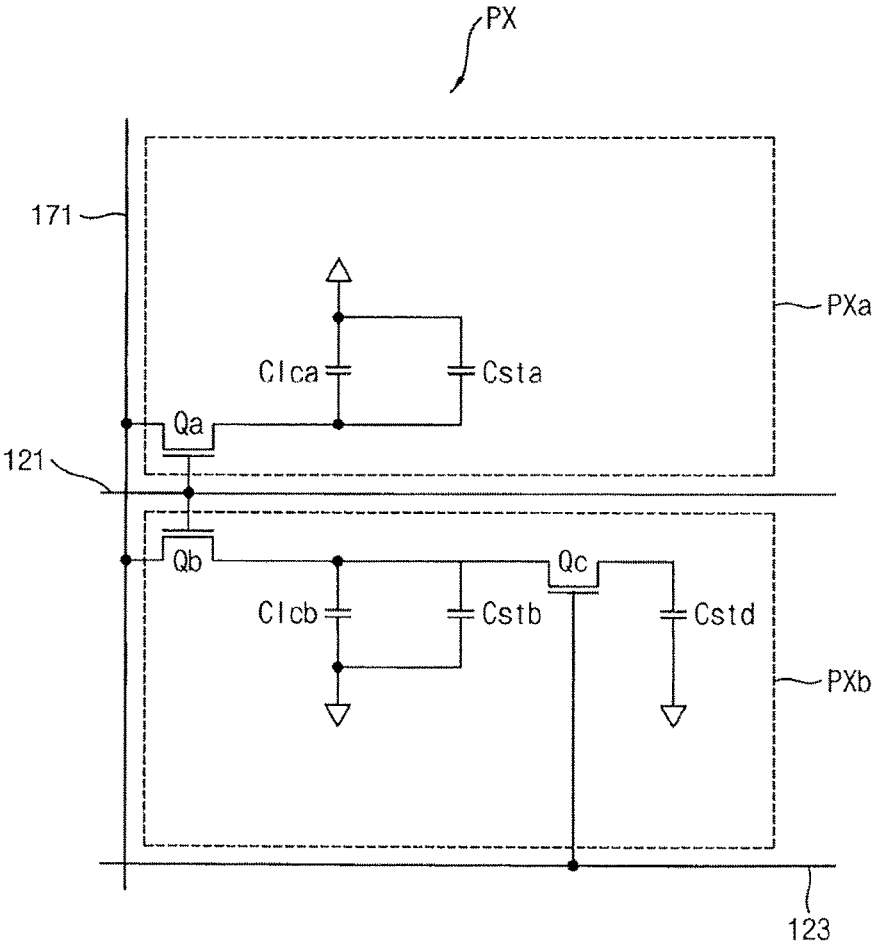
FIGS. 8, 9, 10, 11 and 12 are schematic circuit diagrams illustrating examples of the pixel of FIG. 7.

FIGS. 8, 9, 10, 11 and 12 are circuit diagrams illustrating examples of the pixel of FIG. 7. Referring to FIG. 8, a pixel PX may be connected to signal lines including a gate line 121, a down gate line 123 and a data line 171. The pixel PX may include a first sub-pixel PXa and a second sub-pixel PXb.

The first sub-pixel PXa may include a first switching element Qa, a first liquid crystal capacitor Clca and a first storage capacitor Csta each connected to the first switching element. The second sub-pixel PXb may include second and third switching elements Qb and Qc, a second liquid crystal capacitor Clcb connected to the second switching element, a second storage capacitor Cstb connected to the second switching element and a down capacitor Cstd connected to the third switching element.

The first and second switching elements Qa and Qb may each be connected to the gate line 121 and to the data line 171. Each of the first and second switching elements Qa and Qb may be a thin film transistor. Each of the first and second switching elements may include a control terminal connected to the gate line 121, a first terminal connected to the data line 171, and a second terminal. The second terminal of the first switching element Qa may be connected to the first liquid crystal capacitor Clca and the first storage capacitor Csta. The second terminal of the second switching element Qb may be connected to the second liquid crystal capacitor Clcb, the second storage capacitor Cstb and a first terminal of the third switching element Qc.

The third switching element Qc may be connected to the down gate line 123. The third switching element Qc may also be a thin film transistor. The third switching element Qc may include a control terminal connected to the down gate line 123, the first terminal connected to the second liquid crystal capacitor Clcb and the second storage capacitor Cstb, and a second terminal connected to the down capacitor Cstd. The down capacitor Cstd may be connected between the second terminal of the third switching element Qc and a common voltage.

An exemplary operation of the pixel PX of FIG. 8 will be described in detail. When a gate-on voltage is applied to the gate line 121, the first and second thin film transistors Qa and Qb connected to the gate line 121 may be turned on. A data voltage may be applied to the first and second liquid crystal capacitors Clca and Clcb through the data line 171 and the turned-on first and second switching elements Qa and Qb such that the first and second liquid crystal capacitors Clca and Clcb are charged by a difference between the data voltage and the common voltage. At this time, a gate-off voltage may be applied to the down gate line 123. After that, the gate-off voltage is applied to the gate line 121, the gate-on voltage is simultaneously applied to the down gate line 123, the first and second switching elements Qa and Qb connected to the gate line 121 may be turned off, and the third switching element Qc may be turned on. The charged voltage of the second liquid crystal capacitor Clcb connected to the second terminal of the second switching element Qb may be decreased.

In the pixel PX of FIG. 8, the unsigned magnitude of the charged voltage of the second liquid crystal capacitor Clcb may be smaller than that of the first liquid crystal capacitor Clca regardless of the polarity of the data voltage. Accordingly, the display panel including the pixel PX of FIG. 8 may have high visibility.

Figure 9:
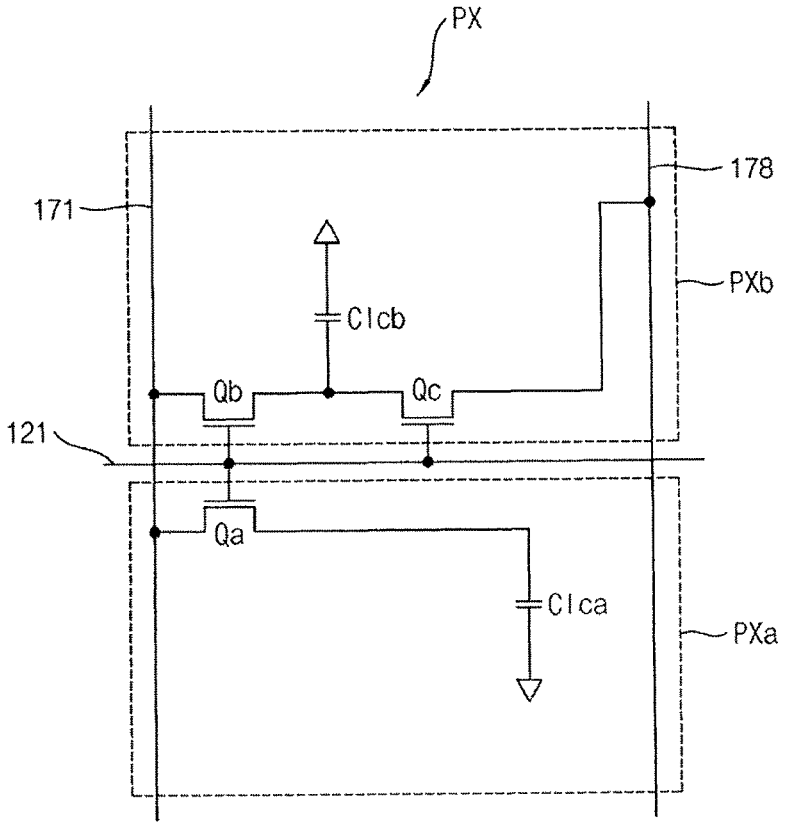

Referring to FIG. 9, a pixel PX may be connected to signal lines including a gate line 121, a data line 171 and a reference voltage line 178. The pixel PX may include a first sub-pixel PXa and a second sub-pixel PXb.

The first sub-pixel PXa may include a first switching element Qa and a first liquid crystal capacitor Clca. The second sub-pixel PXb may include second and third switching elements Qb and Qc and a second liquid crystal capacitor Clcb.

The first and second switching elements Qa and Qb may each be connected to the gate line 121 and to the data line 171. Each of the first and second switching elements Qa and Qb may be a thin film transistor and may include a control terminal connected to the gate line 121, a first terminal connected to the data line 171, and a second terminal. The second terminal of the first switching element Qa may be connected to the first liquid crystal capacitor Clca. The second terminal of the second switching element Qb may be connected to the second liquid crystal capacitor Clcb and a first terminal of the third switching element Qc.

The third switching element Qc may be connected to the reference voltage line 178. The third switching element Qc may also be the thin film transistor and may include a control terminal connected to the gate line 121, the first terminal connected to the second liquid crystal capacitor Clcb, and a second terminal connected to the reference voltage line 178.

An exemplary operation of the pixel PX of FIG. 9 will be described in detail. When a gate-on voltage is applied to the gate line 121, the first, second and third switching elements Qa, Qb and Qc connected to the gate line 121 may be turned on. A data voltage may be applied to the first and second liquid crystal capacitors Clca and Clcb through the data line 171 and the turned-on first and second switching elements Qa and Qb such that the first and second liquid crystal capacitors Clca and Clcb are charged by a difference between the data voltage and the common voltage. At this time, a same voltage, e.g., the data voltage, may be applied to the first and second liquid crystal capacitors Clca and Clcb through the first and second switching elements Qa and Qb, however, the charged voltage of the second liquid crystal capacitor Clcb may be divided by the third switching element Qc. Thus, the charged voltage of the second liquid crystal capacitor Clcb may be lower than the charged voltage of the first liquid crystal capacitor Clca such that luminances of the two sub-pixels PXa and PXb may be different from each other. In the pixel PX of FIG. 9, the voltage charged in the first liquid crystal capacitor Clca and the voltage charged in the second liquid crystal capacitor Clcb may be controlled to improve the visibility of the display panel including the pixel PX of FIG. 9.

Figure 10:
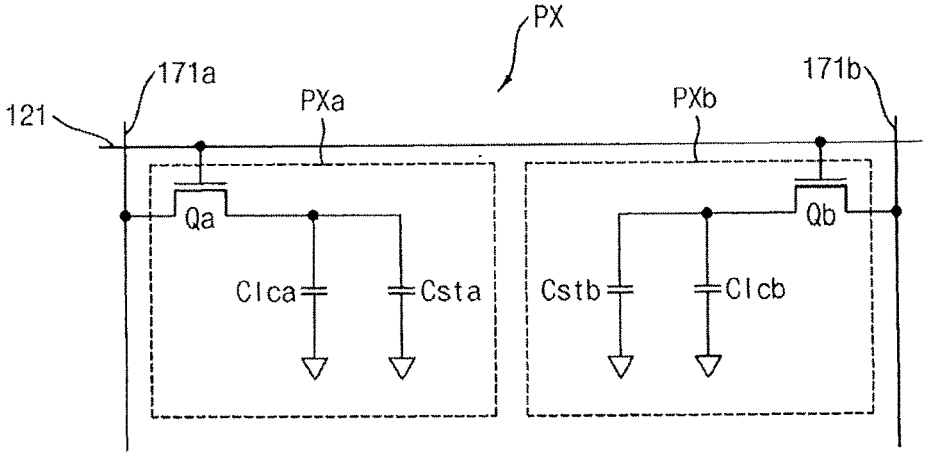

Referring to FIG. 10, a pixel PX may be connected to signal lines including a gate line 121, a first data line 171*a* and a second data line 171*b*. The pixel PX may include a first sub-pixel PXa and a second sub-pixel PXb.

The first sub-pixel PXa may include a first switching element Qa, a first liquid crystal capacitor Clca and a first storage capacitor Csta. The second sub-pixel PXb may include a second switching element Qb, a second liquid crystal capacitor Clcb and a second storage capacitor Cstb.

The first switching element Qa may include a control terminal connected to the gate line 121, a first terminal connected to the first data line 171*a*, and a second terminal connected to the first liquid crystal capacitor Clca and the first storage capacitor Csta. The second switching element Qb may include a control terminal connected to the gate line 121, a first terminal connected to the second data line 171*b*, and a second terminal connected to the second liquid crystal capacitor Clcb and the second storage capacitor Cstb. In the pixel PX of FIG. 10, different data voltages corresponding to the output image data may be applied to the first and second liquid crystal capacitors Clca and Clcb through the first and second switching elements Qa and Qb connected to the different data lines 171*a* and 171*b*, respectively.

Figure 11:
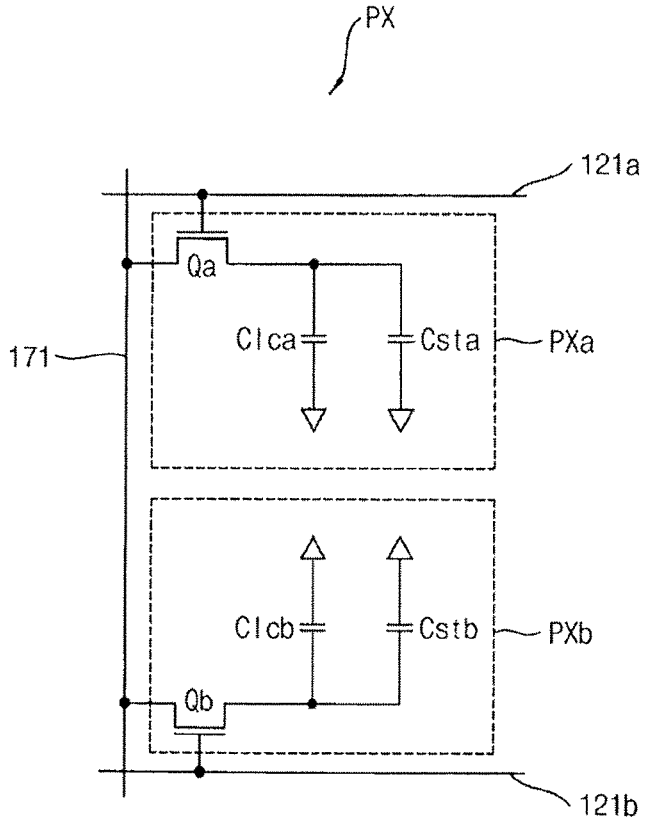

Referring to FIG. 11, a pixel PX may be connected to signal lines including a first gate line 121*a*, a second gate line 121*b* and a data line 171. The pixel PX may include a first sub-pixel PXa and a second sub-pixel PXb.

The first sub-pixel PXa may include a first switching element Qa, a first liquid crystal capacitor Clca and a first storage capacitor Csta. The second sub-pixel PXb may include a second switching element Qb, a second liquid crystal capacitor Clcb and a second storage capacitor Cstb.

The first switching element Qa may include a control terminal connected to the first gate line 121*a*, a first terminal connected to the data line 171, and a second terminal connected to the first liquid crystal capacitor Clca and the first storage capacitor Csta. The second switching element Qb may include a control terminal connected to the second gate line 121*b*, a first terminal connected to the data line 171, and a second terminal connected to the second liquid crystal capacitor Clcb and the second storage capacitor Cstb.

In the pixel PX of FIG. 11, different data voltages corresponding to the output image data may be applied to the first and second liquid crystal capacitors Clca and Clcb at different times through the data line 171 and the first and second switching elements Qa and Qb connected to the different gate lines 121*a* and 121*b*, respectively.

Figure 12:
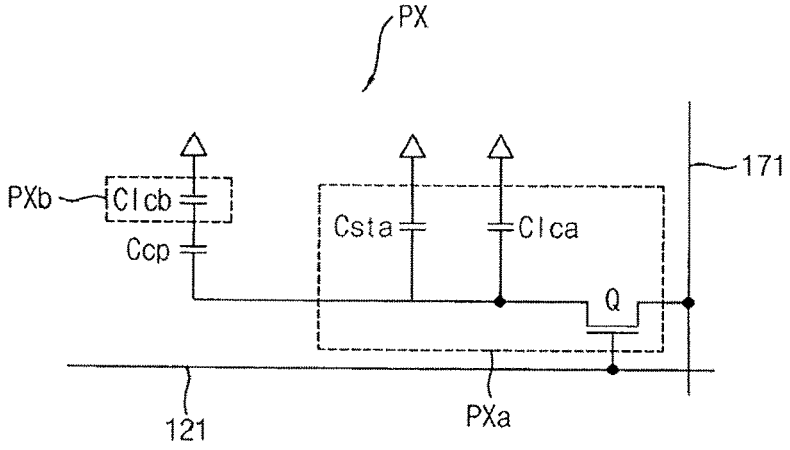

Referring to FIG. 12, a pixel PX may be connected to signal lines including a gate line 121 and a data line 171. The pixel PX may include a first sub-pixel PXa, a second sub-pixel PXb and a coupling capacitor Ccp connected between the first and second sub-pixels PXa and PXb.

The first sub-pixel PXa may include a switching element Q, a first liquid crystal capacitor Clca and a first storage capacitor Csta. The second sub-pixel PXb may include a second liquid crystal capacitor Clcb. The switching element Q may include a control terminal connected to the gate line 121, a first terminal connected to the data line 171, and a second terminal connected to the first liquid crystal capacitor Clca, the first storage capacitor Csta and the coupling capacitor Ccp.

When the switching element Q receives a gate signal through the gate line 121, a data voltage may be applied from the data line 171 to the first liquid crystal capacitor Clca and the coupling capacitor Ccp, and a voltage changed by the coupling capacitor Ccp may be transmitted to the second liquid crystal capacitor Clcb. A charged voltage of the first liquid crystal capacitor Clca and a charged voltage of the second liquid crystal capacitor Clcb may have a relationship represented by Equation 1.

$$Vb=Va*[Ccp/(Ccp+Clcb)] \quad \text{[Equation 1]}$$

In Equation 1, Va denotes the charged voltage of the first liquid crystal capacitor Clca, Vb denotes the charged voltage of the second liquid crystal capacitor Clcb, Ccp denotes a capacitance of the coupling capacitor Ccp, and Clcb denotes a capacitance of the second liquid crystal capacitor Clcb. The charged voltage Vb of the second liquid crystal capacitor Clcb may be lower than the charged voltage Va of the first liquid crystal capacitor Clca. In the pixel PX of FIG. 12, the capacitance of the coupling capacitor Ccp may be controlled to improve the visibility of the display panel including the pixel PX of FIG. 12.

Figure 13A:
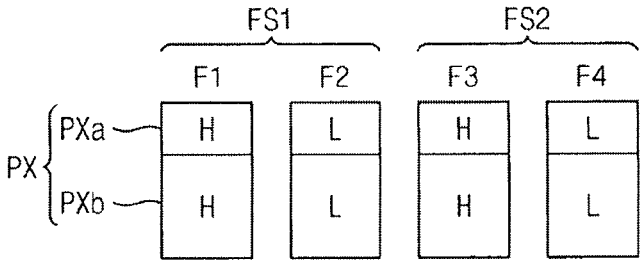
FIGS. 13A and 13B are conceptual diagrams illustrating examples of the TGM scheme based on the pixel of FIG. 7.
Figure 13B:
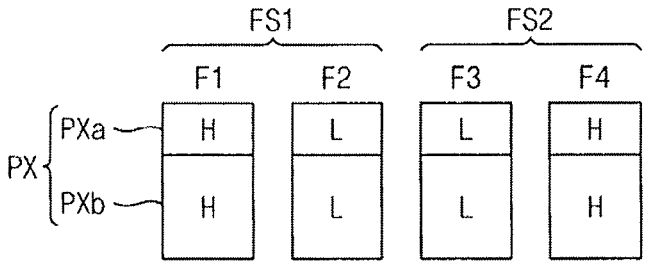

FIGS. 13A and 13B are diagrams illustrating examples of the TGM scheme based on the pixel of FIG. 7. Referring to FIGS. 13A and 13B, the pixel PX may include the sub-pixels PXa and PXb and may operate based on a frame-set-by-frame-set basis, where each frame set includes two frames (e.g., two consecutive frames). For example, a portion of the first output image may be displayed on the pixel PX during the first frame set FS1 (e.g., during the first and second frames F1 and F2), and a portion of the second output image may be displayed on the pixel PX during the second frame set FS2 (e.g., during the third and fourth frames F3 and F4). The first and second frames F1 and F2 may have different durations, and the third and fourth frames F3 and F4 may have different durations.

Images (e.g., referred to as first partial images H) based on the first gamma curve GH in FIG. 4 may be displayed on the sub-pixels PXa and PXb during one of two frames in one frame set, and images (e.g., referred to as second partial images L) based on the second gamma curve GL in FIG. 4 may be displayed on the sub-pixels PXa and PXb during the other of two frames in one frame set. In other words, the images displayed on the sub-pixels PXa and PXb during a same frame may be based on a same gamma curve.

As illustrated in FIG. 13A, each of the sub-pixels PXa and PXb may display the first partial image H during the first frame F1, may display the second partial image L during the second frame F2, may display the first partial image H during the third frame F3, and may display the second partial image L during the fourth frame F4. In an embodiment as illustrated in FIG. 13B, each of the sub-pixels PXa and PXb may display the first partial image H during the first frame F1, may display the second partial image L during the second frame F2, may display the second partial image L during the third frame F3, and may display the first partial image H during the fourth frame F4. Alternatively, as will be described with reference to FIGS. 19A through 19F, images displayed on the sub-pixels PXa and PXb during a same frame may be based on different gamma curves.

Figure 14:
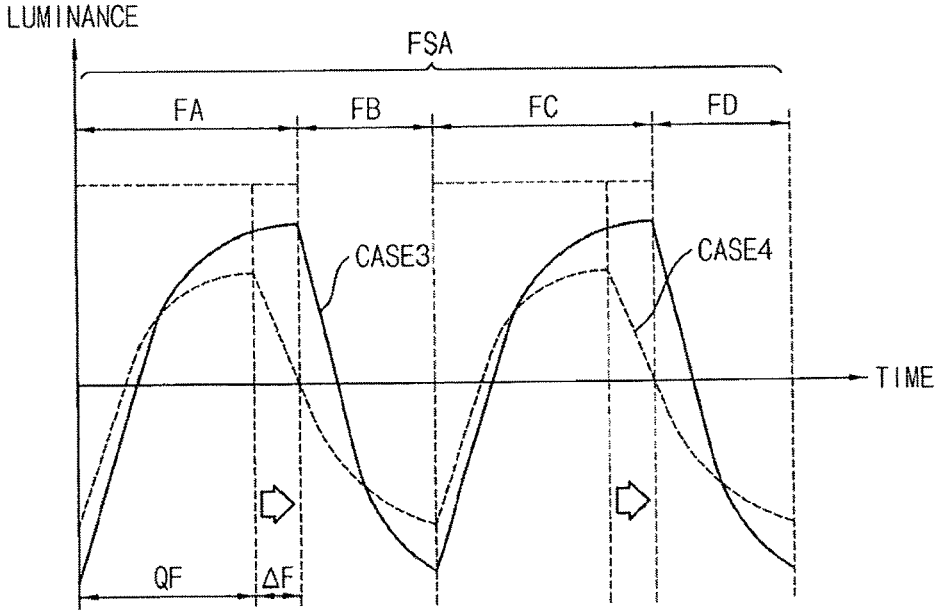
FIGS. 14 and 15 are graphical diagrams for illustrating a method of a display apparatus according to an exemplary embodiment.
Figure 15:
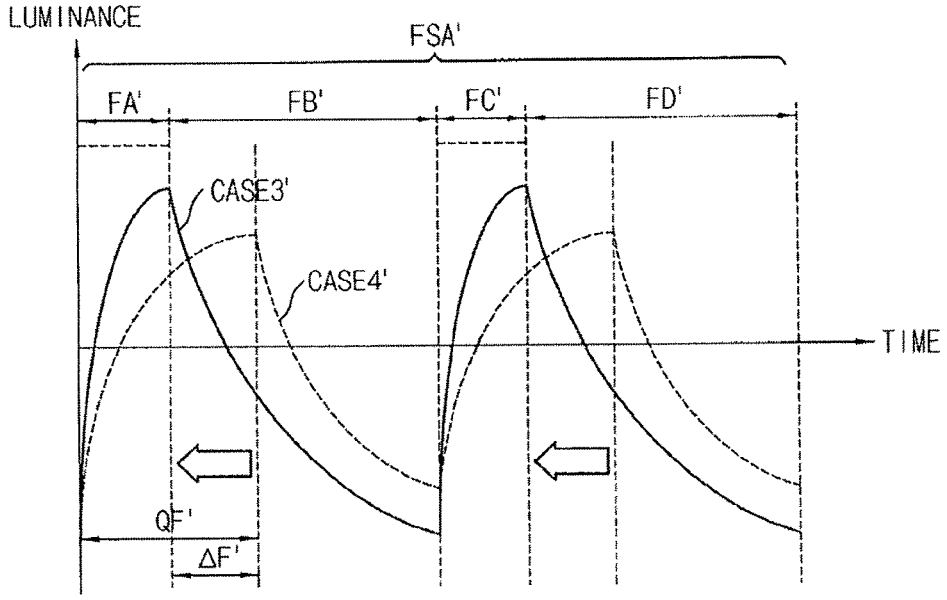

FIGS. 14 and 15 are diagrams for illustrating a method of a display apparatus according to an exemplary embodiment. FIGS. 14 and 15 illustrate a change of luminance by lapse of time or by lapse of frame, but are not limited thereto.

In the method of the display apparatus according to an exemplary embodiment, one frame set (e.g., FSA in FIG. 14) may include four frames (e.g., FA, FB, FC and FD in FIG. 14). A duration of one frame (e.g., FA in FIG. 14) may be different from a duration of another frame (e.g., FB in FIG. 14). The display apparatus may operate based on the AFD and TGM schemes.

Referring to FIGS. 1 and 14, a first frame set FSA includes a first frame FA, a second frame FB, a third frame FC and a fourth frame FD that have different durations. A duration of the second frame FB is different from a duration of the first frame FA, a duration of the third frame FC is different from the duration of the second frame FB, and a duration of the fourth frame FD is different from the duration of the third frame FC. For example, the first, second, third and fourth frames FA, FB, FC and FD may be four consecutive frames.

Although not illustrated in FIG. 14, a second frame set subsequent to the first frame set FSA may include a fifth frame, a sixth frame, a seventh frame and an eighth frame that have different durations. For example, the first and second frame sets may be two consecutive frame sets, and the fifth, sixth, seventh and eighth frames may be four consecutive frames.

The input image data IDAT may include data corresponding to a respective one of a plurality of frame sets. For example, the input image data IDAT may include first input image data corresponding to the first frame set FSA and second input image data corresponding to the second frame set. Similarly, the output image data DAT may include data corresponding to the respective one of the plurality of frame sets. For example, the output image data DAT may include first output image data corresponding to the first frame set FSA and second output image data corresponding to the second frame set.

The timing controller 200 of FIG. 1 generates the first output image data based on the first input image data. The data driver 500 may generate a plurality of first data voltages, a plurality of second data voltages, a plurality of third data voltages and a plurality of fourth data voltages based on the first output image data and the gamma reference voltage VG having information associated with at least two gamma curves.

The display panel 100 displays a first output image based on the first output image data during the first frame set FSA. For example, the display panel 100 displays a first image based on the first output image data (e.g., based on the first data voltages) during the first frame FA, displays a second image based on the first output image data (e.g., based on the second data voltages) during the second frame FB, displays a third image based on the first output image data (e.g., based on the third data voltages) during the third frame FC, and displays a fourth image based on the first output image data (e.g., based on the fourth data voltages) during the fourth frame FD. The first image has first grayscales, the second image has second grayscales different from the first grayscales, the third image has third grayscales different from the second grayscales, and the fourth image has fourth grayscales different from the third grayscales. The first output image includes the first, second, third and fourth images. In other words, the first output image may be displayed on the display panel 100 by combining the first, second, third and fourth images.

As illustrated in FIG. 14, the duration of the first frame FA may be longer than the duration of the second frame FB. For example, the duration of the first frame FA may be longer than a quarter duration QF of the first frame set FSA by ΔF. The duration of the second frame FB may be shorter than the quarter duration QF of the first frame set FSA by ΔF. Similarly, the duration of the third frame FC may be longer than the duration of the fourth frame FD.

As illustrated in FIG. 14, a rising response for a liquid crystal (LC) in the display panel 100 may be implemented during the first and third frames FA and FC, and a falling response for the LC may be implemented during the second and fourth frames FB and FD. In some exemplary embodiments, when a half of a sum of the durations of the first and second frames FA and FB is equal to or greater than a reference falling time for the LC, it may be determined that the duration of the first frame FA is longer than the duration of the second frame FB. In comparison with the symmetric frame dividing scheme (e.g., CASE4 in FIG. 14), a rising time for the rising response may increase without a loss of the reference falling time in the AFD scheme (e.g., CASE3 in FIG. 14).

In an exemplary embodiment, the durations of the third and fourth frames FC and FD may be substantially the same as the durations of the first and second frames FA and FB, respectively. Alternatively, although not illustrated in FIG. 14, the durations of the third and fourth frames FC and FD may be different from the durations of the first and second frames FA and FB, respectively.

Although not illustrated in FIG. 14, an operation of the display apparatus 10 during the second frame set may be substantially the same as the operation of the display apparatus 10 during the first frame set FSA. The timing controller 200 may generate the second output image data based on the second input image data. The display panel 100 may display a second output image based on the second output image data during the second frame set. For example, the display panel 100 may display fifth, sixth, seventh and eighth images based on the second output image data during the fifth, sixth, seventh and eighth frames, respectively. The second output image may be displayed on the display panel 100 by combining the fifth, sixth, seventh and eighth images that have different grayscales.

Referring to FIGS. 1 and 15, a first frame set FSA' includes a first frame FA', a second frame FB', a third frame FC' and a fourth frame FD' that have different durations. For example, the first, second, third and fourth frames FA', FB', FC' and FD' may be four consecutive frames. Although not illustrated in FIG. 15, a second frame set subsequent to the first frame set FSA' may include a fifth frame, a sixth frame, a seventh frame and an eighth frame that have different durations. For example, the first and second frame sets may be two consecutive frame sets, and the fifth, sixth, seventh and eighth frames may be four consecutive frames.

An example of FIG. 15 may be similar to the example of FIG. 14 except that a frame configuration in FIG. 15 is different from a frame configuration in FIG. 14. The timing controller 200 generates first output image data based on first input image data corresponding to the first frame set FSA'. The display panel 100 displays a first output image based on the first output image data during the first frame set FSA'. For example, the display panel 100 displays first, second, third and fourth images based on the first output image data during the first, second, third and fourth frames FA', FB', FC' and FD', respectively. The first output image may be displayed on the display panel 100 by combining the first, second, third and fourth images that have different grayscales. In addition, the timing controller 200 may generate second output image data based on second input image data corresponding to the second frame set. The display panel 100 may display a second output image based on the second output image data during the second frame set. For example, the display panel 100 may display fifth, sixth, seventh and eighth images based on the second output image data during the fifth, sixth, seventh and eighth frames, respectively. The second output image may be displayed on the display panel 100 by combining the fifth, sixth, seventh and eighth images that have different grayscales.

As illustrated in FIG. 15, the duration of the first frame FA' may be shorter than the duration of the second frame FB'. For example, the duration of the first frame FA' may be shorter than a quarter duration QF' of the first frame set FSA' by ΔF'. The duration of the second frame FB' may be longer than the quarter duration QF' of the first frame set FSA' by ΔF'. Similarly, the duration of the third frame FC' may be shorter than the duration of the fourth frame FD'.

As illustrated in FIG. 15, the rising response for the LC in the display panel 100 may be performed during the first and third frames FA' and FC', and the falling response for the LC may be performed during the second and fourth frames FB' and FD'. In some exemplary embodiments, when a half of a sum of the durations of the first and second frames FA' and FB' is less than a reference falling time for the LC, it may be determined that the duration of the first frame FA' is shorter than the duration of the second frame FB'. In comparison with the symmetric frame dividing scheme (e.g., CASE4' in FIG. 15), a falling time for the falling response may be set as close as possible to the reference falling time in the AFD scheme (e.g., CASE3' in FIG. 15).

Figure 16:
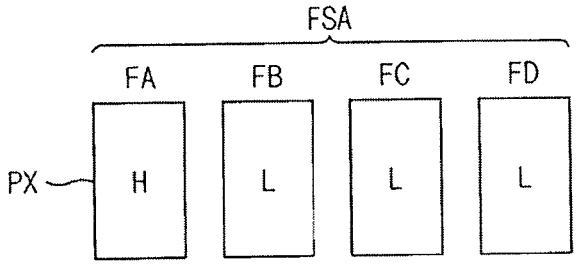
FIGS. 16, 17A and 17B are conceptual diagrams illustrating examples of the TGM scheme based on the pixel of FIG. 5.
Figure 17A:
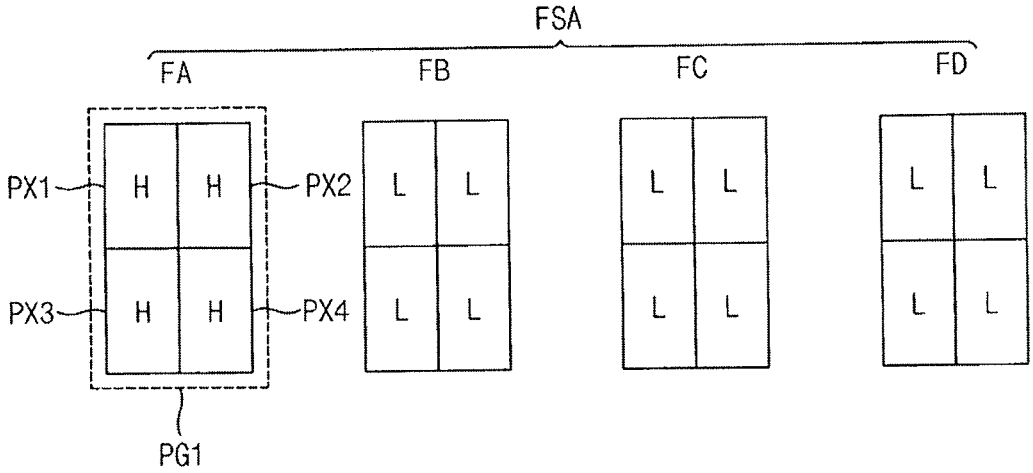
Figure 17B:
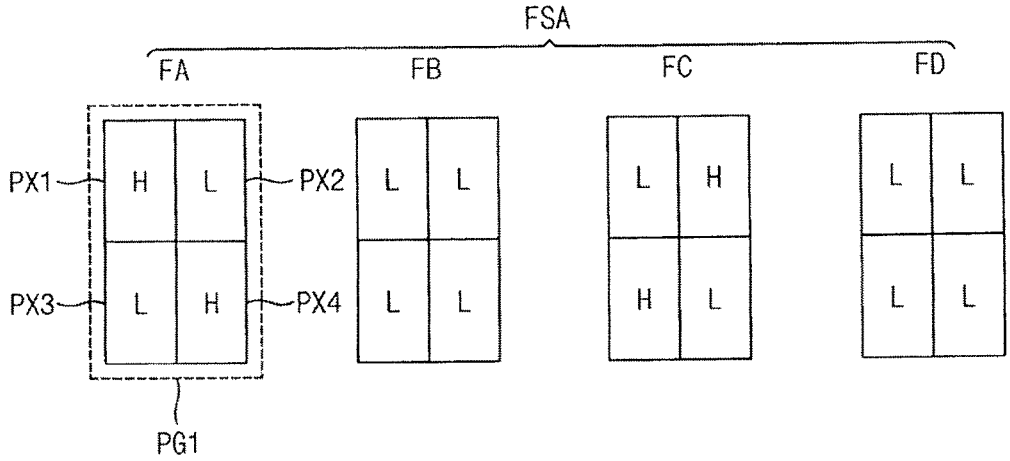

Examples based on the AFD scheme (e.g., illustrated in FIGS. 14 and 15) and the TGM scheme will be explained in detail with reference to FIGS. 16, 17A and 17B. FIGS. 16, 17A and 17B are diagrams illustrating examples of the TGM scheme based on the pixel of FIG. 5.

Referring to FIG. 16, the pixel PX may operate based on a frame-set-by-frame-set basis, where each frame set includes four frames (e.g., four consecutive frames). For example, a portion of the first output image may be displayed on the pixel PX during the first frame set FSA (e.g., during the first, second, third and fourth frames FA, FB, FC and FD). The duration of the second frame FB may be different from the duration of the first frame FA, the duration of the third frame FC may be different from the duration of the second frame FB, and the duration of the fourth frame FD may be different from the duration of the third frame FC.

A partial image H based on the first gamma curve GH in FIG. 4 may be displayed by the pixel PX during one of four frames in one frame set, and a partial image L based on the second gamma curve GL in FIG. 4 may be displayed by the pixel PX during the others (e.g., three) of four frames in one frame set.

As illustrated in FIG. 16, a first data voltage applied to the pixel PX during the first frame FA may be generated based on the first gamma curve GH in FIG. 4, and second, third and fourth data voltages applied to the pixel PX during the second, third and fourth frames FB, FC and FD, respectively, may be generated based on the second gamma curve GL in FIG. 4. In other words, the pixel PX may display the partial image H during the first frame FA and may display the partial image L during the second, third and fourth frames FB, FC and FD.

Although not illustrated in FIG. 16, during one frame set subsequent to the first frame set FSA, the partial images may be displayed on the pixel PX in a sequence of H-L-L-L, which is substantially the same as a display sequence during the first through fourth frames FA~FD in FIG. 16, or in a sequence of L-L-L-H, which is different from the display sequence during the first through fourth frames FA~FD in FIG. 16. Alternatively, although not illustrated in FIG. 16, the partial images may be displayed on the pixel PX in a sequence of H-L-H-L during the first through fourth frames FA~FD.

Referring to FIGS. 17A and 17B, a plurality of pixels PX1, PX2, PX3 and PX4 may form one pixel group PG1. Each of the pixels PX1, PX2, PX3 and PX4 may operate based on a frame-set-by-frame-set basis, where each frame set includes four frames (e.g., four consecutive frames). For example, each of the portions of the first output image may be displayed on a respective one of the pixels PX1, PX2, PX3 and PX4 during the first frame set FSA (e.g., during the first, second, third and fourth frames FA, FB, FC and FD). The first, second, third and fourth frames FA, FB, FC and FD may have different durations. For example, the first and second frames FA and FB may have different durations, and the third and fourth frames FC and FD may have different durations.

In an exemplary embodiment, as illustrated in FIG. 17A, the pixels PX1, PX2, PX3 and PX4 may operate based on the AFD scheme and the TGM scheme. In addition, all of the pixels PX1, PX2, PX3 and PX4 may operate based on a same display sequence. For example, similar to the example of FIG. 16, each of the pixels PX1, PX2, PX3 and PX4 in the one pixel group PG1 may display the partial image H during the first frame FA, and may display the partial image L during the second, third and fourth frames FB, FC and FD.

In an exemplary embodiment, as illustrated in FIG. 17B, the pixels PX1, PX2, PX3 and PX4 may operate based on the AFD scheme and the TGM scheme. In addition, some of the pixels PX1, PX2, PX3 and PX4 may operate based on different display sequences. In other words, the pixels PX1, PX2, PX3 and PX4 in FIG. 17B may operate based on a gamma sequence mixing scheme.

In FIG. 17B, data voltages applied to the pixels PX1 and PX4 during the first frame FA may be generated based on the first gamma curve GH in FIG. 4, and data voltages applied to the pixels PX1 and PX4 during the second, third and fourth frames FB, FC and FD may be generated based on the second gamma curve GL in FIG. 4. In other words, each of the pixels PX1 and PX4 may display the partial image H during the first frame FA and may display the partial image L during the second, third and fourth frames FB, FC and FD. In addition, data voltages applied to the pixels PX2 and PX3 during the third frame FC may be generated based on the first gamma curve GH in FIG. 4, and data voltages applied to the pixels PX2 and PX3 during the first, second and fourth frames FA, FB and FD may be generated based on the second gamma curve GL in FIG. 4. In other words, each of the pixels PX2 and PX3 may display the partial image H during the third frame FC and may display the partial image L during the first, second and fourth frames FA, FB and FD. A flicker level may be desirably low in the display panel 100 operating based on the gamma sequence mixing scheme.

Figure 18:
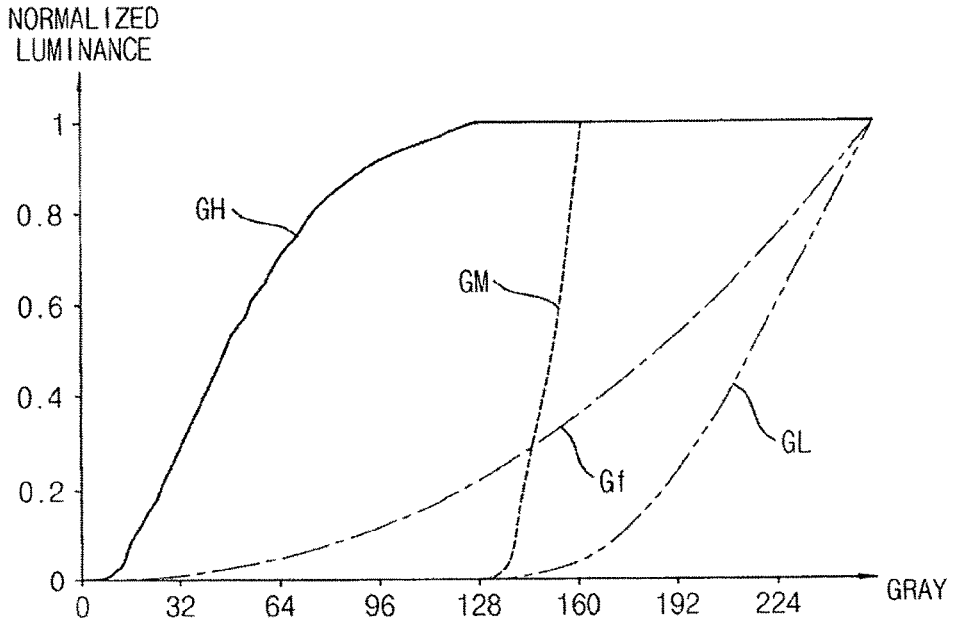
FIG. 18 is a graphical diagram illustrating an example of gamma curves that are used in the display apparatus according to an exemplary embodiment.

Other examples based on the AFD scheme and the TGM scheme will be explained in detail with reference to FIGS. 18, 19A, 19B, 19C, 19D, 19E, 19F, 20A, 20B and 20C. FIG. 18 is a graph illustrating examples of gamma curves that may be used in the display apparatus according to an exemplary embodiment.

Referring to FIGS. 1 and 18, the gamma reference voltage VG may be generated based on a first gamma curve GH, a second gamma curve GL and a third gamma curve GM. A luminance of an image based on the first gamma curve GH may be equal to or higher than a luminance of an image based on the third gamma curve GM, and the luminance of the image based on the third gamma curve GM may be equal to or higher than a luminance of an image based on the second gamma curve GL. The first, second and third gamma curves GH, GL and GM may be controlled such that a combination gamma curve of the first, second and third gamma curves GH, GL and GM conforms with a reference gamma curve Gf, which is determined to substantially maximize the display quality of the display panel 100. In such an embodiment, the combination gamma curve might not have an inflection point near a position having a maximum value, and the first, second and third gamma curves GH, GL and GM may be controlled to be close to the reference gamma curve Gf, thereby providing excellent display quality. In an exemplary embodiments, the display apparatus 10 may include a storage (not illustrated) that stores gamma data associated with the first, second and third gamma curves GH, GL and GM.

FIGS. 19A, 19B, 19C, 19D, 19E and 19F are diagrams illustrating examples of the TGM scheme based on the pixel of FIG. 7. Referring to FIGS. 19A, 19B, 19C, 19D, 19E and 19F, the pixel PX may include the sub-pixels PXa and PXb and may operate based on a frame-set-by-frame-set basis, where each frame set includes two frames (e.g., two consecutive frames). For example, a portion of the first output image may be displayed by the pixel PX during the first frame set FS1 (e.g., during the first and second frames F1 and F2), and a portion of the second output image may be displayed by the pixel PX during the second frame set FS2 (e.g., during the third and fourth frames F3 and F4). The first and second frames F1 and F2 may have different durations, and the third and fourth frames F3 and F4 may have different durations.

Figure 19A:
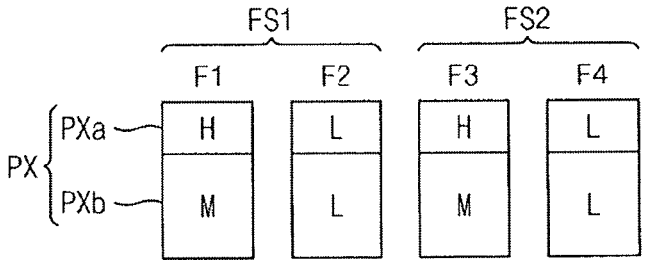
FIGS. 19A, 19B, 19C, 19D, 19E and 19F are conceptual diagrams illustrating examples of the TGM scheme based on the pixel of FIG. 7.

As illustrated in FIG. 19A, during one of two frames in one frame set, the first sub-pixel PXa may display a partial image H based on the first gamma curve GH in FIG. 18, and the second sub-pixel PXb may display a partial image M based on the third gamma curve GM in FIG. 18. During the other of two frames in one frame set, each of the first and second sub-pixels PXa and PXb may display a partial image L based on the second gamma curve GL in FIG. 18.

Figure 19B:
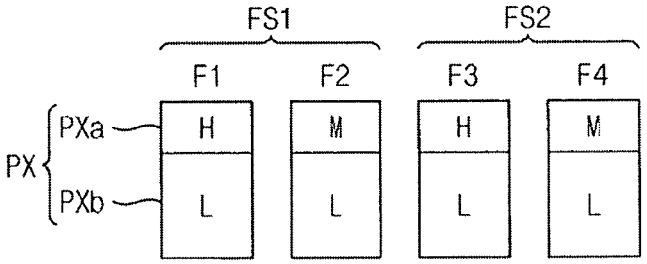

In an exemplary embodiment, as illustrated in FIG. 19B, during one of two frames in one frame set, the first sub-pixel PXa may display the partial image H based on the first gamma curve GH in FIG. 18, and the second sub-pixel PXb may display the partial image L based on the second gamma curve GL in FIG. 18. During the other of two frames in one frame set, the first sub-pixel PXa may display the partial image M based on the third gamma curve GM in FIG. 18, and the second sub-pixel PXb may display the partial image L based on the second gamma curve GL in FIG. 18.

Figure 19C:
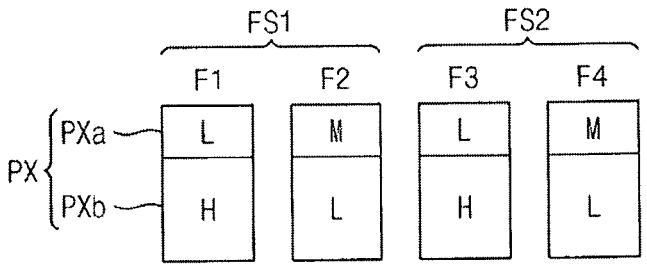

In an exemplary embodiment, as illustrated in FIG. 19C, during one of two frames in one frame set, the first sub-pixel PXa may display the partial image L based on the second gamma curve GL in FIG. 18, and the second sub-pixel PXb may display the partial image H based on the first gamma curve GH in FIG. 18. During the other of two frames in one frame set, the first sub-pixel PXa may display the partial image M based on the third gamma curve GM in FIG. 18, and the second sub-pixel PXb may display the partial image L based on the second gamma curve GL in FIG. 18.

Figure 19D:
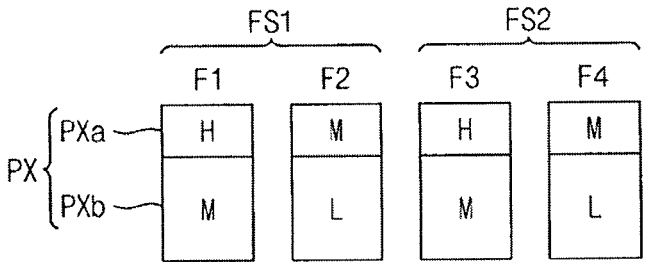

In an exemplary embodiment, as illustrated in FIG. 19D, during one of two frames in one frame set, the first sub-pixel PXa may display the partial image H based on the first gamma curve GH in FIG. 18, and the second sub-pixel PXb may display the partial image M based on the third gamma curve GM in FIG. 18. During the other of two frames in one frame set, the first sub-pixel PXa may display the partial image M based on the third gamma curve GM in FIG. 18, and the second sub-pixel PXb may display the partial image L based on the second gamma curve GL in FIG. 18.

Figure 19E:
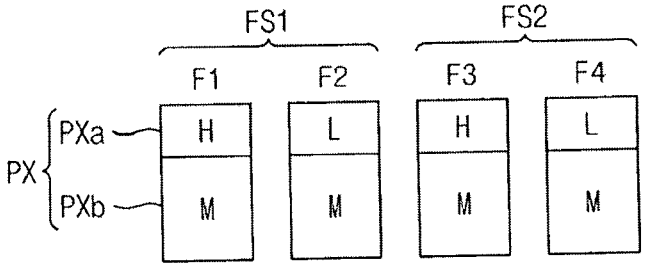

In an exemplary embodiment, as illustrated in FIG. 19E, during one of two frames in one frame set, the first sub-pixel PXa may display the partial image H based on the first gamma curve GH in FIG. 18, and the second sub-pixel PXb may display the partial image M based on the third gamma curve GM in FIG. 18. During the other of two frames in one frame set, the first sub-pixel PXa may display the partial image L based on the second gamma curve GL in FIG. 18, and the second sub-pixel PXb may display the partial image M based on the third gamma curve GM in FIG. 18.

Figure 19F:
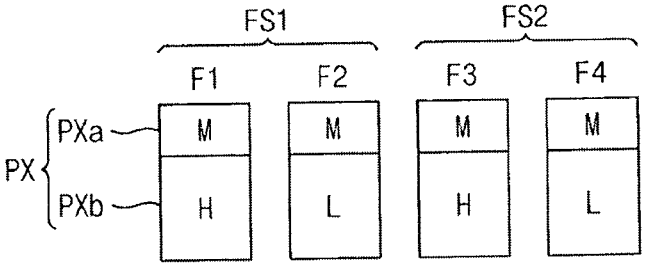

In an exemplary embodiment, as illustrated in FIG. 19F, during one of two frames in one frame set, the first sub-pixel PXa may display the partial image M based on the third gamma curve GM in FIG. 18, and the second sub-pixel PXb may display the partial image H based on the first gamma curve GH in FIG. 18. During the other of two frames in one frame set, the first sub-pixel PXa may display the partial image M based on the third gamma curve GM in FIG. 18, and the second sub-pixel PXb may display the partial image L based on the second gamma curve GL in FIG. 18.

According to an exemplary embodiment using the TGM scheme and the AFD scheme based on the pixel of FIG. 7, the images based on the different gamma curves may be displayed on the sub-pixels PXa and PXb such that the combination gamma curve (e.g., the combination of GH, GL and GM in FIG. 18) is substantially close to the reference gamma curve Gf in FIG. 18, thereby providing excellent transmittance and visibility.

Although not fully illustrated in FIGS. 19A through 19F, during the second frame set FS2, and/or during two frame sets subsequent to the second frame set FS2, the images may be displayed on the sub-pixels PXa and PXb in various display sequences. Alternatively, although not illustrated in FIGS. 19A through 19F, the pixel of FIG. 7 may operate based on a frame-set-by-frame-set basis, where each frame set includes four frames (e.g., four consecutive frames).

Figure 20A:
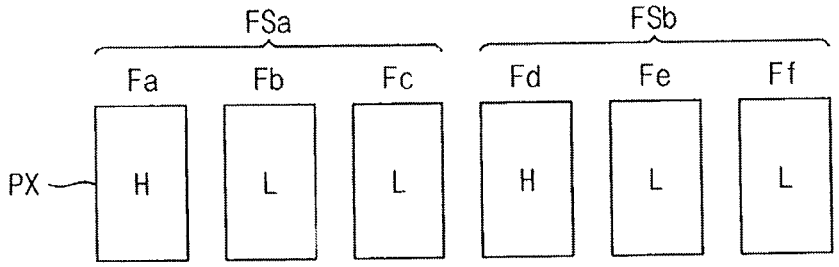
FIGS. 20A, 20B and 20C are conceptual diagrams illustrating examples of the TGM scheme based on the pixel of FIG. 5.
Figure 20B:
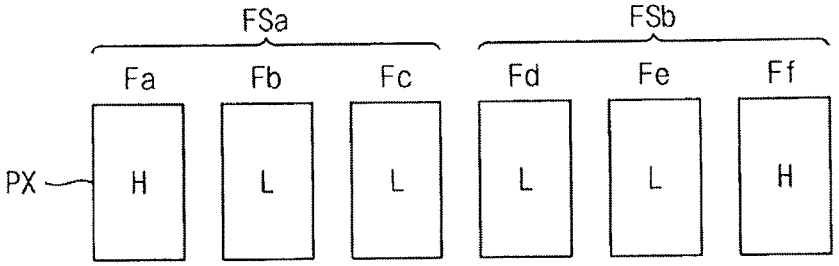
Figure 20C:
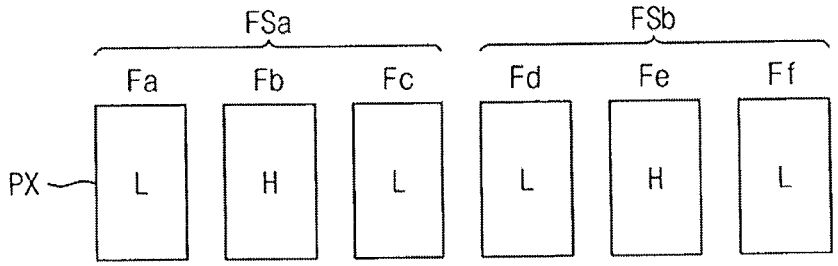

FIGS. 20A, 20B and 20C are diagrams illustrating examples of the TGM scheme based on the pixel of FIG. 5. Referring to FIGS. 20A, 20B and 20C, the pixel PX may operate based on a frame-set-by-frame-set basis, where each frame set includes three frames (e.g., three consecutive frames). For example, a portion of the first output image may be displayed on the pixel PX during a first frame set FSa (e.g., during first, second and third frames Fa, Fb and Fc), and a portion of the second output image may be displayed on the pixel PX during a second frame set FSb (e.g., during fourth, fifth and sixth frames Fd, Fe and Ff). The first, second and third frames Fa, Fb and Fc may have different durations, and the fourth, fifth and sixth frames Fd, Fe and Ff may have different durations. A partial image H based on the first gamma curve GH in FIG. 4 may be displayed on the pixel PX during one of three frames in one frame set, and a partial image L based on the second gamma curve GL in FIG. 4 may be displayed on the pixel PX during the others (e.g., two) of three frames in one frame set.

In an exemplary embodiment, as illustrated in FIG. 20A, the pixel PX may display the partial image H during the first and fourth frames Fa and Fd and may display the partial image L during the second, third, fifth and sixth frames Fb, Fc, Fe and Ff. In an exemplary embodiment, as illustrated in FIG. 20B, the pixel PX may display the partial image H during the first and sixth frames Fa and Ff and may display the partial image L during the second, third, fourth and fifth frames Fb, Fc, Fd and Fe. In an exemplary embodiment, as illustrated in FIG. 20C, the pixel PX may display the partial image H during the second and fifth frames Fb and Fe and may display the partial image L during the first, third, fourth and sixth frames Fa, Fc, Fd and Ff.

Figure 21:
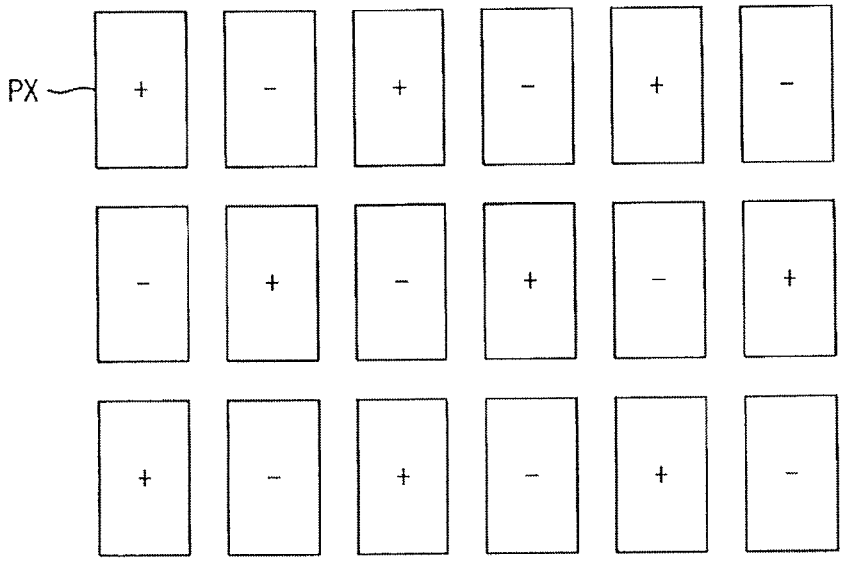
FIGS. 21, 22A and 22B are conceptual diagrams for describing an operation and a structure of a display panel included in the display apparatus according to an exemplary embodiment.
Figure 22A:
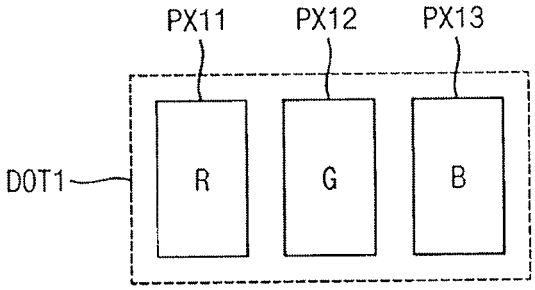
Figure 22B:
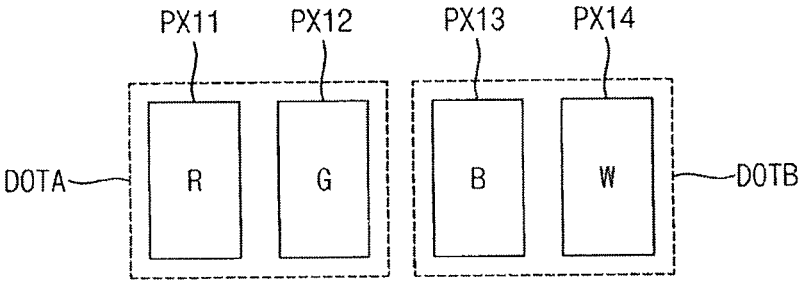

FIGS. 21, 22A and 22B are diagrams for describing an operation and a structure of a display panel included in the display apparatus according to an exemplary embodiment. Referring to FIGS. 1 and 21, the display panel 100 may operate based on an inversion driving scheme in which a polarity of a data voltage applied to each pixel is reversed with respect to the common voltage at every predetermined period. A characteristic of the liquid crystal in the display panel 100 might be preserved due to the inversion driving scheme. For example, as illustrated in FIG. 21, the display panel 100 may have a polarity pattern of a dot or diagonal inversion where a single pixel is surrounded on its top, bottom, left and right by pixels having a polarity opposite to that of the single pixel. Although not fully illustrated in FIG. 21, the display panel 100 may have a polarity pattern of a line inversion (e.g., a column inversion or a row inversion) where pixels in a single column or row have the same polarity as each other.

Referring to FIGS. 1 and 22A, a first dot DOT1 may include a first pixel PX11, a second pixel PX12 and a third pixel PX13. For example, the first pixel PX11 may be a red pixel outputting red light, the second pixel PX12 may be a green pixel outputting green light, and the third pixel PX13 may be a blue pixel outputting blue light. In this case, the display panel 100 may include a plurality of dots, each of which is substantially the same as the first dot DOT1.

In an exemplary embodiment, three pixels in one dot may display partial images based on a same gamma curve, and two adjacent dots may display partial images based on different gamma curves. For example, during a first frame, the pixels PX11, PX12 and PX13 in the first dot DOT1 may display the partial images H based on the first gamma curve GH in FIG. 4, and pixels in a second dot adjacent to the first dot DOT1 may display the partial images L based on the second gamma curve GL in FIG. 4.

Referring to FIGS. 1 and 22B, a first dot DOTA may include a first pixel PX11 and a second pixel PX12, and a second dot DOTB may include a third pixel PX13 and a fourth pixel PX14. For example, the first pixel PX11 may be a red pixel outputting red light, the second pixel PX12 may be a green pixel outputting green light, the third pixel PX13 may be a blue pixel outputting blue light, and the fourth pixel PX14 may be a white pixel outputting white light. In this case, the display panel 100 may include a plurality of dots. Some of the plurality of dots may be substantially the same as the first dot DOTA, and others of the plurality of dots may be substantially the same as the second dot DOTB.

In an exemplary embodiment, two pixels in one dot may display partial images based on a same gamma curve, and two adjacent dots may display partial images based on at least one different gamma curve. For example, during a first frame, the pixels PX11 and PX12 in the first dot DOTA may display the partial images H based on the first gamma curve GH in FIG. 4, and the pixels PX13 and PX14 in the second dot DOTB may display the partial images L based on the second gamma curve GL in FIG. 4.

Although exemplary embodiments of the inventive concept using AFD schemes may be readily understood in conjunction with specific TGM schemes, specific pixel structures, specific gamma sequence mixing schemes and specific panel structures, embodiments may be modified and employed in which the display apparatus operates based on at least one of various driving schemes and/or the display apparatus has at least one of various pixel/panel structures.

The above described embodiments may be used in a display apparatus and/or a system including the display apparatus, such as a mobile phone, a smart phone, a PDA, a PMP, a digital camera, a digital television, a set-top box, a music player, a portable game console, a navigation device, a personal computer (PC), a server computer, a workstation, a tablet computer, a laptop computer, a smart card, a printer, and the like. For example, such a display apparatus or system may utilize a Liquid Crystal Display (LCD), a Light Emitting Diode (LED) display, or a plasma display, but is not limited thereto.

The foregoing is illustrative of exemplary embodiments and is not to be construed as limiting thereof. Although exemplary embodiments have been described, those of ordinary skill in the pertinent art will readily appreciate that many modifications are possible in the exemplary embodiments without materially departing from the novel teachings and spirit of the present inventive concept. Accordingly, all such modifications are intended to be included within the scope of the present inventive concept as defined in the appended claims. Therefore, it is to be understood that the foregoing is illustrative of various exemplary embodiments and is not to be construed as limited to the specific exemplary embodiments disclosed, and that modifications to the exemplary embodiments disclosed herein, as well as all other embodiments, are intended to be included within the scope of the appended claims.

What is claimed is:

1. A display apparatus comprising:

a timing controller configured to generate first output image data based on first input image data corresponding to a first frame set; and a display panel including a plurality of pixels, the display panel configured to display a first output image based on the first output image data during the first frame set, wherein the first frame set includes a first frame and a second frame, a duration of the second frame being different from a duration of the first frame, and wherein the first output image includes a first image and a second image, the first image having first grayscales and being displayed on the display panel during the duration of the first frame, the second image having second grayscales different from the first grayscales and being displayed on the display panel during the duration of the second frame;

wherein the first frame set further includes a third frame and a fourth frame, a duration of the third frame being different from the duration of the second frame, a duration of the fourth frame being different from the duration of the third frame, wherein the first output image further includes a third image and a fourth image, the third image having third grayscales different from the second grayscales and being displayed on the display panel during the duration of the third frame, and the fourth image having fourth grayscales different from the third grayscales and being displayed on the display panel during the duration of the fourth frame; and wherein a rising response for a liquid crystal in the display panel is implemented during the first and third frames, and wherein a falling response for the liquid crystal is implemented during the second and fourth frames.

2. The display apparatus of claim 1, wherein the first and second frames are two consecutive frames.

3. The display apparatus of claim 1, wherein a rising response for a liquid crystal in the display panel is implemented during the first frame, and wherein a falling response for the liquid crystal is implemented during the second frame.

4. The display apparatus of claim 3, wherein the duration of the first frame is longer than the duration of the second frame.

5. The display apparatus of claim 3, wherein the duration of the first frame is shorter than the duration of the second frame.

6. The display apparatus of claim 5, wherein the timing controller performs a dynamic capacitance compensation (DCC) on the first input image data to compensate the rising response for the liquid crystal.

7. The display apparatus of claim 1, wherein a first data voltage applied to a first pixel among the plurality of pixels during the duration of the first frame is generated based on a first gamma curve, and wherein a second data voltage applied to the first pixel during the duration of the second frame is generated based on a second gamma curve different from the first gamma curve.

8. The display apparatus of claim 7, wherein a luminance of a first partial image displayed on the first pixel based on the first data voltage is higher than a luminance of a second partial image displayed on the first pixel based on the second data voltage.

9. The display apparatus of claim 7, wherein a polarity of the first data voltage with respect to a common voltage is different from a polarity of the second data voltage with respect to the common voltage.

10. The display apparatus of claim 1, wherein the timing controller further generates second output image data based on second input image data corresponding to a second frame set subsequent to the first frame set, wherein the display panel further displays a second output image based on the second output image data during the second frame set, wherein the second frame set includes a third frame and a fourth frame, a duration of the fourth frame being different from a duration of the third frame, and wherein the second output image includes a third image and a fourth image, the third image having third grayscales and being displayed on the display panel during the duration of the third frame, and the fourth image having fourth grayscales different from the third grayscales and being displayed on the display panel during the duration of the fourth frame.

11. The display apparatus of claim 10, wherein a first data voltage applied to a first pixel among the plurality of pixels during the duration of the first frame and a second data voltage applied to the first pixel during the duration of the third frame are generated based on a first gamma curve, and wherein a third data voltage applied to the first pixel during the duration of the second frame and a fourth data voltage applied to the first pixel during the duration of the fourth frame are generated based on a second gamma curve different from the first gamma curve.

12. The display apparatus of claim 10, wherein a first data voltage applied to a first pixel among the plurality of pixels during the duration of the first frame and a second data voltage applied to the first pixel during the duration of the fourth frame are generated based on a first gamma curve, and wherein a third data voltage applied to the first pixel during the duration of the second frame and a fourth data voltage applied to the first pixel during the duration of the third frame are generated based on a second gamma curve different from the first gamma curve.

13. The display apparatus of claim 1, wherein each of the plurality of pixels includes a first sub-pixel and a second sub-pixel.

14. The display apparatus of claim 13, wherein a first partial image displayed on the first sub-pixel and a second partial image displayed on the second sub-pixel are generated based on different gamma curves.

15. The display apparatus of claim 1, wherein the first, second, third and fourth frames are four consecutive frames.

16. The display apparatus of claim 1, wherein the duration of the first frame is longer than the duration of the second frame, and wherein the duration of the third frame is longer than the duration of the fourth frame.

17. The display apparatus of claim 1, wherein the duration of the first frame is shorter than the duration of the second frame, and wherein the duration of the third frame is shorter than the duration of the fourth frame.

18. The display apparatus of claim 17, wherein the timing controller performs a dynamic capacitance compensation (DCC) on the first input image data to compensate the rising response for the liquid crystal.

19. The display apparatus of claim 1, wherein a first data voltage applied to a first pixel among the plurality of pixels during the first frame and a second data voltage applied to the first pixel during the third frame are generated based on a first gamma curve, and wherein a third data voltage applied to the first pixel during the second frame and a fourth data voltage applied to the first pixel during the fourth frame are generated based on a second gamma curve different from the first gamma curve.

20. The display apparatus of claim 1, wherein a first data voltage applied to a first pixel among the plurality of pixels during the first frame is generated based on a first gamma curve, and wherein a second data voltage applied to the first pixel during the second frame, a third data voltage applied to the first pixel during the third frame and a fourth data voltage applied to the first pixel during the fourth frame are generated based on a second gamma curve different from the first gamma curve.

21. The display apparatus of claim 20, wherein a fifth data voltage applied to a second pixel adjacent to the first pixel during the first frame is generated based on the first gamma curve, and wherein a sixth data voltage applied to the second pixel during the second frame, a seventh data voltage applied to the second pixel during the third frame and an eighth data voltage applied to the second pixel during the fourth frame are generated based on the second gamma curve.

22. The display apparatus of claim 20, wherein a fifth data voltage applied to a second pixel adjacent to the first pixel during the first frame, a sixth data voltage applied to the second pixel during the second frame, a seventh data voltage applied to the second pixel during the fourth frame are generated based on the second gamma curve, and wherein an eighth data voltage applied to the second pixel during the third frame is generated based on the first gamma curve.

23. The display apparatus of claim 1 wherein:

the first and second frames are two consecutive frames with either preceding the other, respectively;

a rising response for a liquid crystal in the display panel is implemented during the first frame, and a falling response for the liquid crystal is implemented during the second frame;

the duration of the first frame is shorter than the duration of the second frame; and the timing controller performs a dynamic capacitance compensation (DCC) on the first input image data to compensate the rising response for the liquid crystal.

24. The display apparatus of claim 23 wherein the first and second durations are variable based on a difference in pixel data values between those corresponding to the first and second images.

25. The display apparatus of claim 23 wherein the first and second durations are variable based on a difference in at least one of physical, electrical, performance, or degradation parameters between the first and second images.

26. The display apparatus of claim 23 wherein the first and second images comprise a plurality of same pixels at different times.

27. The display apparatus of claim 23 wherein the first and second images comprise different pixels at a substantially same time.

28. The display apparatus of claim 23, further comprising a gamma generator coupled between an output from the timing controller and an input to the plurality of pixels, wherein the gamma generator is configured to apply different gamma curves to at least some of the plurality of pixels for the first and second images, respectively, based on the output from the timing controller.

29. A method of operating a display apparatus, the method comprising:

generating first output image data based on first input image data corresponding to a first frame set including a plurality of frames;

displaying a first image on a display panel based on the first output image data during a duration of a first frame of the plurality of frames, the first image having first grayscales; and displaying a second image on the display panel based on the first output image data during a duration of a second frame of the plurality of frames, the second image having second grayscales different from the first grayscales, and wherein the duration of the second frame is different from the duration of the first frame, displaying a third image on the display panel based on the first output image data during a duration of a third frame of the plurality of frames, the third image having third grayscales different from the second grayscales, wherein the duration of the third frame is different from at least one of the durations of the second and first frames, and wherein the first output image displayed on the display panel during the first frame set includes the third image, displaying a fourth image on the display panel based on the first output image data during a duration of a fourth frame of the plurality of frames, the fourth image having fourth grayscales different from the third grayscales, wherein the duration of the fourth frame is different from the duration of the third frame, and wherein the first output image displayed on the display panel during the first frame set includes the fourth image, and wherein a rising response for a liquid crystal in the display panel is performed during the first and third frames, and wherein a falling response for the liquid crystal is performed during the second and fourth frames.

30. The method of claim 29, wherein the first and second frames are two consecutive frames.

31. The method of claim 29, wherein a rising response for a liquid crystal in the display panel is implemented during the duration of the first frame, and wherein a falling response for the liquid crystal is implemented during the duration of the second frame.

32. The method of claim 31, wherein the duration of the first frame is longer than the duration of the second frame.

33. The method of claim 31, wherein the duration of the first frame is shorter than the duration of the second frame.

34. The method of claim 29, wherein the first, second, third and fourth frames are four consecutive frames.

35. The method of claim 29, wherein the duration of the first frame is longer than the duration of the second frame, and wherein the duration of the third frame is longer than the duration of the fourth frame.

36. The method of claim 29, wherein the duration of the first frame is shorter than the duration of the second frame, and wherein the duration of the third frame is shorter than the duration of the fourth frame.

37. The method of claim 29, further comprising:

generating a first data voltage for a pixel among a plurality of pixels in at least one frame of the first frame set based on a first gamma curve; and generating a second data voltage for the pixel in at least another frame of the frame set based on a second gamma curve.

38. The method of claim 29, further comprising:

generating a first data voltage for a first pixel or sub-pixel among a plurality of pixels in at least one frame of the first frame set based on a first gamma curve; and generating a second data voltage for a second pixel or sub-pixel in the at least one frame of the frame set based on a second gamma curve.

* * * * *